US009960559B2

(12) United States Patent
Pratt et al.

(10) Patent No.: US 9,960,559 B2
(45) Date of Patent: May 1, 2018

(54) LATCHING ROTARY CONNECTOR SYSTEM

(71) Applicant: EXTENSIVE ENERGY TECHNOLOGIES PARTNERSHIP, Calgary (CA)

(72) Inventors: F. Dale Pratt, Calgary (CA); Kenneth A. Lambe, Calgary (CA)

(73) Assignee: EXTENSIVE ENERGY TECHNOLOGIES PARTNERSHIP, Calgary, Alberta (CA)

( * ) Notice: Subject to any disclaimer, the term of this patent is extended or adjusted under 35 U.S.C. 154(b) by 0 days. days.

(21) Appl. No.: 15/334,781

(22) Filed: Oct. 26, 2016

(65) Prior Publication Data

US 2017/0117677 A1 Apr. 27, 2017

Related U.S. Application Data

(60) Provisional application No. 62/246,715, filed on Oct. 27, 2015.

(51) Int. Cl.

| | |
|---|---|
| ***H01R 13/52*** | (2006.01) |
| ***H01R 35/04*** | (2006.01) |
| ***H01R 13/631*** | (2006.01) |

(52) U.S. Cl.

CPC ..... *H01R 35/04* (2013.01); *H01R 13/631* (2013.01)

(58) Field of Classification Search

CPC ..... H01R 13/5219; H01R 13/5202; H01R 13/521; H01R 13/5221; H01R 13/523

(Continued)

(56) References Cited

U.S. PATENT DOCUMENTS 3,050,658 A * 8/1962 Lay ..... H01T 13/05 174/359
3,060,417 A * 10/1962 Blake ..... B64D 45/02 174/88 R (Continued)

FOREIGN PATENT DOCUMENTS

WO WO/2006/025899 2/2006

OTHER PUBLICATIONS

10-Conductor Male In-Line Concentric Stab Connector, and 10 Conductor Female In-Line Concentric Stab Connector, manufactured by Canyon Manufacturing Services, Inc., printout available online on Oct. 24, 2016 at: https://web.archive.org/web/20150924070401/http://www.canyon-mfg.com/connectors, 2 pages.

(Continued)

*Primary Examiner* — Abdullah Riyami
*Assistant Examiner* — Valdimir Imas
(74) *Attorney, Agent, or Firm* — Heslin Rothenberg Farley & Mesiti P.C.; Victor A. Cardona, Esq.

(57) ABSTRACT

A rotary connector device for making a plurality of electrical connections in a mating arrangement between two components includes a male component with a large diameter end part transitioning to a slope-stepped part having a surface defined by outer sidewalls of alternating male conducting rings and male insulating rings and a female component having a central bore configured to retain a series of alternating female conductor rings and insulating rings. Each of the male conducting rings is connectable to an electrical line and each of the female conducting rings is connectable to an electrical line. Each of the female conducting rings makes direct or indirect conductive contact with a corresponding male conducting ring of the male conducting rings when the mating arrangement is made. The male conducting rings and (Continued)

the female conducting rings, or separate conducting components associated therewith, have contact surfaces with complementary shapes that engage each other in a latching mechanism when the mating arrangement is made.

44 Claims, 15 Drawing Sheets

(58) Field of Classification Search
USPC ..... 439/271
See application file for complete search history.

(56) References Cited

U.S. PATENT DOCUMENTS 3,193,636 A * 7/1965 Daniels ..... H01R 24/58 191/12 R
3,396,586 A * 8/1968 Maclin ..... G01C 19/10 310/232
3,552,777 A * 1/1971 Heinrich et al. ..... H01R 13/622 285/81
3,593,415 A * 7/1971 Wofford ..... H01R 13/523 174/21 JS
3,665,509 A * 5/1972 Elkins ..... H01R 13/523 439/271
3,885,849 A * 5/1975 Bailey ..... H01R 13/506 439/320
4,029,380 A * 6/1977 Yonkers ..... H01H 9/085 174/72 R
4,074,924 A * 2/1978 Lebecque ..... B60L 5/36 191/22 R
4,178,051 A * 12/1979 Kocher ..... H01R 13/633 439/157
4,583,798 A * 4/1986 Blazowich ..... H01R 39/64 439/24
5,007,852 A * 4/1991 Dean ..... H01R 13/523 439/201
5,240,437 A * 8/1993 Christian ..... A61B 8/06 439/13
5,358,409 A * 10/1994 Obara ..... A61N 1/02 439/20
5,389,003 A * 2/1995 Van Steenwyk ..... E21B 17/028 439/190
5,409,403 A * 4/1995 Falossi ..... H01R 24/38 439/21
5,468,153 A * 11/1995 Brown ..... E21B 17/028 439/13
5,809,136 A * 9/1998 Turner ..... H01R 24/58 379/437
5,820,416 A * 10/1998 Carmichael ..... E21B 17/028 166/65.1
5,927,402 A * 7/1999 Benson ..... E21B 21/103 166/324
5,967,816 A * 10/1999 Sampa ..... E21B 17/028 439/190
6,010,348 A * 1/2000 Alden ..... H01R 13/506 439/274
6,033,250 A * 3/2000 Pauza ..... H01R 13/6275 439/357
6,183,293 B1 * 2/2001 Kieninger ..... H01R 13/746 439/312
6,439,932 B1 * 8/2002 Ripolone ..... E21B 17/028 439/668
6,910,910 B2 * 6/2005 Cairns ..... G02B 6/3816 174/13
7,040,909 B2 * 5/2006 Cairns ..... G02B 6/3816 439/271
7,052,297 B2 * 5/2006 Panzar ..... H01R 13/187 439/169
7,131,844 B1 * 11/2006 Wurr ..... H01R 39/08 439/20
7,611,378 B1 * 11/2009 Brekosky ..... H01R 13/5202 439/500
7,695,333 B2 * 4/2010 Strickland, Jr. .... H01R 13/5221 439/737
8,033,833 B1 * 10/2011 Lai ..... H01R 39/64 439/21
8,480,437 B2 * 7/2013 Dilmaghanian ..... H01R 13/40 439/669
8,636,549 B2 * 1/2014 Pratt ..... H01R 13/625 439/668
9,160,099 B2 * 10/2015 Pfiffi ..... H01R 13/5205
9,203,184 B1 * 12/2015 Hui ..... H01R 13/629

OTHER PUBLICATIONS

Bal Spring Canted Coil Springs, manufactured by Bal Spring Engineering, Inc., printout available online on Oct. 24, 2016 at: www.balseal.com/springs, 4 pages.

* cited by examiner

LATCHING ROTARY CONNECTOR SYSTEM

CROSS-REFERENCE TO RELATED APPLICATIONS

This application claims priority from U.S. Provisional Application Ser. No. 62/246,715, filed on Oct. 27, 2015, the entire disclosure of which is incorporated herein by reference in its entirety.

FIELD OF THE INVENTION

The invention relates to systems for making electrical connections in harsh environments. More particularly, the present invention relates to a latchable rotary electrical connector system which makes and maintains a series of electrical connections.

BACKGROUND OF THE INVENTION

Connector systems that either maintain electrical continuity while a first connector member may be rotatable with respect to a second connector member or allow for rotation while engaging or disengaging of connector members are useful in down hole assembly applications in resource extraction, marine applications and other applications involving operation of electrical equipment in harsh conditions. In operation it is known that a circular contact may be employed around or within a connector member to contact a mating member having a non-circular contact.

Existing connectors often use a circular contact around the outer surface of the male connector rod or probe and a circular contact around the interior surface of the receiver or female connector to transfer a signal through the connector. An example of such a contact is described in U.S. Pat. No. 5,389,003 (incorporated herein by reference in its entirety) which discloses a wireline wet connection between receivers and probes. A conducting ring consists of a bow spring element wrapped about a conductive cylinder and bowed outwardly to make positive pressure electrical contact with a contact ring embedded in the insulative body, and a conductive inner spring element captive within the inner diameter of the receiver.

U.S. Pat. No. 5,468,153 (incorporated herein by reference in its entirety) discloses a rotatable electrical connector. A mandrel includes an enlarged hollow cylindrical head with circumferential grooves into which beryllium copper wiper springs are mounted so as to contact the interior of the housing. A brass head also has two circumferential grooves into which beryllium copper wiper springs are mounted. Continuous electric contact on the "hot wire" of the wireline is maintained between a rotor and stator through the beryllium copper wiper springs which continuously provide approximately 100 or more electrical contact points between the mating surfaces. Continuous electric contact of the "ground" is similarly maintained between the head of the mandrel and the upper housing by the beryllium copper wiper springs.

U.S. Pat. No. 5,820,416 (incorporated herein by reference in its entirety) discloses a multiple contact wet connector that includes a probe assembly having a nose portion that removably fits within an axial cavity in a receiver assembly. The receiver is constructed to hold and maintain the relative longitudinal position of a circular spring contact. In an alternative embodiment, the circular spring contacts are affixed on three sides in the probe electrical contact which extends to the surface of the probe. Use of a circular spring in such a channel on a surface-exposed contact as either the receiver or probe contact is disclosed.

U.S. Pat. No. 5,927,402 and U.S. Pat. No. 5,967,816 (each of which is incorporated herein by reference in its entirety) disclose a receiver assembly having a series of receiver contacts disposed about a common axis. Each contact is machined from a single piece of electrically conductive material and has a sleeve portion with eight extending fingers. The fingers are shaped to bow radially inward, in other words to have, from sleeve portion to a distal end, a first portion that extends radially inward and a second portion that extends radially outward, forming a radially innermost portion with a contact length of about 0.150 inch. By machining contact from a single piece of stock, the fingers, in their relaxed state as shown, have no residual bending stresses that tend to reduce their fatigue resistance.

U.S. Pat. No. 6,439,932 (incorporated herein by reference in its entirety) discloses a multiple contact connector having a receiver and a probe. The receiver has conductor rings, or contact rings embedded in the inner surface of an insulator at predetermined unique axial spacings. The probe has contact rings embedded within its outer surface corresponding axially to the receptacle contact rings.

U.S. Pat. No. 3,060,417 (incorporated herein by reference in its entirety) discloses a conical connector with circular brushes and rings in a system of fire-detectors within an aircraft. This connector is static, meaning that when in operation, they do not rotate one against the other. The ring configuration is meant to permit the electrical connecting of two components by screwing them together, which necessitated (in this design) connectors which could be rotated in relation to each other during assembly. The connector has a male conical end the outer surface of which has grooves with a metallic feature each connected to an external electronic, and in each groove is slidably positioned a metallic split ring in contact, when positioned, with the metallic feature. The female mating part (a conical receptacle) has deployed about its inner surface inner contact strips which touch the split rings when the male and female parts or screwed together for assembly. The conical nature of the parts is meant to compress the split rings against the contact strips to make and hold a good electrical connection, yet provide ease of disassembly and assembly. The connector is static in the sense that it does not rotate when in use, but rather is held tight, one mating part static against the other. The connector is meant for deployment in fire-detection systems on aircraft requiring a robust but refittable connector system to easily assemble, disassemble and check, and reassemble a network of longitudinally spaced thermistor-based temperature sensors. The connector is not meant for harsh environments, or to maintain connection while its parts rotate in relation to each other during normal operation.

U.S. Pat. No. 3,665,509 (incorporated herein by reference in its entirety) provides for an electrical connector set comprising a conical male connector and a mating conical receptacle to reliably and safely make electrical connections at great depths underwater. The male plug has contact rings deployed around its outer surface, perpendicular to its axis, and the female receptacle has connecting surfaces which match and correspond to the contact rings when the plug is seated in the receptacle. The male plug also has means to provide vacuum pressure differentials to the interface of the male and female components to assist them in mating, seating, sealing and maintaining their mated position. The plug, once seated, does not rotate in the socket. This device is meant to provide a multi-trace electrical connection to a salvage pontoon which may be placed, seated, and secured in a static position sealed from intrusion of seawater, by a pressure differential introduced by lowering the fluid pressure in the space between the male and female components to a pressure below the ambient fluid pressure in the deep water within which the device is submerged when used.

U.S. Pat. No. 7,131,844 (incorporated herein by reference in its entirety) discloses a dynamic rotary electrical connector for use in applications such as providing electrical connections between a static device to wires within a cable on a rotating reel. It provides a series of flat washer-like metallic contact surfaces of consecutively smaller outer and inner diameter placed on a non-conducting circular body with increasingly smaller steps (from one end to the other), each step meant to hold one washer-like contact surface. The contact surfaces are connected to electrical traces within the stepped body, which is mounted to a fixture at the axis of a reel, with the contact surfaces facing the reel. A second part, holding brushes which are each sprung to be held in contact with a matching washer-like contact ring is mounted to the cable reel on the side of the reel facing the stepped body so that the brushes are biased to contact their matching contact ring and provide electrical connection from the static device through the stepped body's traces to the contact rings then to the brushes and from each brush to a wire within the cable for which the reel is made. The connector system is generally open to the environment.

U.S. Pat. No. 3,193,636 (incorporated herein by reference in its entirety) describes a rotatable multiple-lead electrical connector with an essentially conical male plug with circumferential connector ring contacts embedded into the plug's outer surface, each shaped in cross-section as a "W"; and a matching conical female receptacle with internal circumferentially mating connectors comprised of multiple spring contact arms shaped in cross-section roughly as a "V", to engage the "V" shape with the "W" shape, so that the connector rings form a mechanism to retain male plug in the receptacle. When engaged, the male connector rings each connect with a mating spring-ring in the female receptacle. Electrical signals are provided to the female receptacle by wires within the non-conductive body of the receptacle affixed to the "V" shaped embedded spring contact arms, and to the male plug by wires through the plug's body and soldered to each "W" shaped ring connector. Further, each ring connector and each set of contact arms may be split into radial segments, each segment with its own electrical lead; in this way, partial rotation of the engaged plug or socket will change the electrical connection (from one set of mated radial ring segments to another set, on each of the male and female elements).

U.S. Pat. No. 7,052,297 and PCT Publication No. WO 2006/025899 (each of which is incorporated herein by reference in its entirety) disclose a rotary connector with removable/refittable contacts. A roughly cylindrical male plug is built-up of alternating insulator and conductor rings stacked on a central core which is a metal rod covered with an insulating layer. Wring is provided to each connector ring by passing through each previously-stacked insulator and conductor ring. A mating receptacle is provided with conductors spaced within its cavity at circumferences spaced to match the spacing of the conductor rings on the plug, when assembled. Electrical ground is provided through the core's metal rod to a connector on the plug's tip end. The connectors either on the male plug's probe or within the receptacle's body are made of a springy, elastic circular contact which, when the plug is engaged and contacts are made, touches each of a conductor ring and female circumferential conductor in at least one spot to make electrical connection. The connection is kept when the plug is engaged whether or not the plug is rotated within the receptacle. The connector requires holes to be made in each conductor and insulator ring prior to assembly, and then the alignment of each hole for insertion of electrical leads, which must be insulated since they pass through conductor rings to which they are not meant to connect. When any conductor or insulator ring rotates during use, there is a tendency for the holes through which the leads pass to misalign. Each time that occurs, a cutting stress is placed on the leads' insulator layer, and eventually, the lead will either become uninsulated at that point of contact with a conductor, or be severed. Multiple holes are required to maintain constant alignment, and misalignment of one ring will cause multiple lead failures.

U.S. Pat. No. 8,636,549 (incorporated herein by reference in its entirety) discloses a contact bayonet electrical connector system including a male component with a small cylindrical tip and a larger conical middle part and a female component adapted to receive the male component and make electrical connections via electrically conducting rings. The conical middle part of the male component has a strict conical shape with electrically conducting rings and insulating rings forming a consistent slope. It is indicated that, by virtue of the conical structure, during the insertion and removal of the male component from the female component none of the traces within the conical section slide against or are connected with any of the other traces, and when the connection is made the connection is made properly between all circuits roughly simultaneously.

U.S. Pat. No. 3,885,849 (incorporated herein by reference in entirety) discloses an electrical connector consisting of molded male and female inserts. One of the inserts is provided with a locking mechanism based on a spring latch configured to project into an opening on the opposing insert. The latching mechanism is disengaged by pressing on the spring latch and pulling on the insert containing the spring latch.

U.S. Pat. No. 3,050,658 (incorporated herein by reference in entirety) discloses a detachable shielded waterproof electrical connector system appropriate for shielding a spark plug lead. The system includes two parts configured to engage each other using a lug and groove engagement.

U.S. Pat. No. 3,552,777 (incorporated herein by reference in entirety) discloses a self-locking threaded electrical connector with one of the two mating sections of the connector having indentations or holes and the other connector having balls that fit into the holes as the two parts are threaded.

U.S. Pat. No. 3,593,415 (incorporated herein by reference in entirety) discloses a method of assembling electrical cables underwater by threading them together in a work area free of water provided by a membrane.

U.S. Pat. No. 4,178,051 (incorporated herein by reference in entirety) discloses a latch/eject pin header arrangement appropriate for connection of pin terminals in a mating connector.

U.S. Pat. No. 5,240,437 (incorporated herein by reference in entirety) discloses a guide wire assembly including a guide wire with first and second conductors extending along its length. The assembly includes a male connector with a sleeve protecting a conductive core. The corresponding female connector has an inner conductive grip portion with a cylindrical recess for accepting the conductive core in frictional contact.

U.S. Pat. No. 5,358,409 (incorporated herein by reference in its entirety) discloses a rotary connector for a flexible elongate member having electrical properties and having a proximal extremity with at least first and second conductive sleeves provided thereon. An outer housing is provided which has a bore therein. First and second spaced-apart conductive disks are mounted in the bore. The conductive disks are sized so that the conductive sleeves can extend therethrough and make electrical contact therewith. Leads are coupled to the conductive disks. A gripping mechanism is carried by the housing for retaining the proximal extremity of the flexible elongate member in the housing. The gripping mechanism is a push-button grip mechanism located at a distance from the conductive disks.

U.S. Pat. No. 6,033,250 (incorporated herein by reference in its entirety) discloses an electrical connector which is capable of establishing both electrical and mechanical connection between a wiring harness and a printed circuit board. The electrical connector has a header being mechanically secured to the printed circuit and a plug connected at the end of a wiring harness. A latch is disposed along an edge of the plug and has a main body from which a latch arm is bent at a right angle and extends along a central axis from the body to a free end. The free end is defined by a securing portion being slightly larger than the remainder of the latch arm. The securing portion has a locking projection extending therefrom at the free end. A spring arm also extends at an acute angle from the body angle and towards the latch arm. The free end of the spring arm is profiled to engage an outer surface of the plug housing so that when a force is applied to the body it will cause deflection of the spring arm to generate a motion of the latch arm along the central axis.

U.S. Pat. No. 6,183,293 (incorporated herein by reference in its entirety) discloses an electrical connector for mounting in an opening in a wall is provided, where the connector includes connector and clamp elements that can be threaded together with a large helical angle thread such as a bayonet thread, for resisting loosening. The connector element has a holder ring and at least one latch member mounted on the holder ring. The clamp element has a latch ring which surrounds the holder ring and that has a plurality of radial projections. The latch member has a fixed proximal end, and has a distal end biased to a position in the path of the projections as an element turns. The latch member can be a resilient beam whose distal end has a radially outer surface that is easily deflected inwardly during turning in a direction to tighten the threads. The distal end has a tip with a surface that greatly resists turning of the elements in a direction to loosen the threaded connection. The latch member is preferably an elastomerically deflectable beam.

U.S. Pat. No. 8,033,833 (incorporated herein by reference in its entirety) discloses a rotatable connector including a first rotating member and a second rotating member rotatably coupled to each other. The first rotating member includes a first surface and an opposite second surface. The first surface forms first pins, and the second surface forms fixing bodies each comprising a first portion and a second portion. The first portion and the second portion cooperatively define a latching groove therebetween. The second rotating member includes a third surface opposing the first rotating member and an opposite fourth surface. The third surface forms circular latching bodies rotatably retained within the latching groove. The fourth surface forms second pins. The fixing bodies and the latching bodies cooperatively define cavities fully filled in electrical conductive material. The wires that are respectively fixed to the first pins and the second pins are capable of being electrically connected by the electrical conductive material.

A pair of products named "10-conductor male" and "10-conductor female" (https://web.archive.org/web/20150924070401/http://www.canyon-mfg.com/connectors, incorporated herein by reference in its entirety) comprise a rotatable connector system marketed by Canyon Manufacturing Services Inc. (Houston, Tex., USA). The male conductor has three portions of different diameters with a slope-step separating the smallest diameter portion from the middle diameter portion and a slope step separating middle diameter portion from the large diameter portion. Conducting contacts are provided on each of the male portions.

There remain a number of problems to be solved in efforts to improve systems for making electrical connections in harsh environments.

SUMMARY OF THE INVENTION

One aspect of the invention is a rotary connector device for making a plurality of electrical connections in a mating arrangement between two components, the device comprising: a male component with a large diameter end part transitioning to a slope-stepped part having a surface defined by outer sidewalls of alternating male conducting rings and male insulating rings, wherein each of the male conducting rings is connectable to an electrical line; and a female component having a central bore configured to retain a series of alternating female conductor rings and insulating rings, wherein each of the female conducting rings makes direct or indirect conductive contact with a corresponding male conducting ring of the male conducting rings when the mating arrangement is made, wherein each of the female conducting rings is connectable to an electrical line, wherein the male conducting rings and the female conducting rings, or separate conducting components associated therewith, have contact surfaces with complementary shapes that engage each other in a latching mechanism when the mating arrangement is made.

In some embodiments, the complementary shapes of the male conducting rings and the female conducting rings are provided by indentations in the male conducting rings and protrusions in the female conducting rings which are substantially complementary in shape to the indentations.

In some embodiments, the separate conducting components of the female conducting rings are conducting springs held within openings with circumferential cavities in the female conducting rings.

In some embodiments, the conducting springs are canted coil springs.

In some embodiments, the circumferential cavities are each defined by a five-sided polygonal inner sidewall defined by two opposed vertical walls connected to a horizontal floor by two angled walls.

In some embodiments, the male conducting rings each have circumferential indentations and the conducting springs provide convex surfaces complementary to the indentations of the male conducting rings, wherein mating of the convex surfaces to the indentations provides a compression force for the latching mechanism.

In some embodiments, the central bore is non-circular and the female conducting rings and female insulating rings are non-circular.

In some embodiments, the central bore is stadium-shaped and the female conducting rings and female insulating rings are stadium-shaped.

In some embodiments, the central bore has a sidewall with at least one transverse groove formed therein, for providing a channel for application of an adhesive for fixing the female conducting rings and female insulating rings in place during manufacture of the female component.

In some embodiments, the female conducting rings and the female insulating rings have outer slots providing passages for a plurality of electrical lines.

In some embodiments, the male component has a conducting extension configured to enter a matched recess in an insulating ring at the central bore's back end, wherein entry of the conducting extension into the matched recess serves to centralize the male component to provide consistent circumferential contact of the male conducting rings with corresponding female conducting springs.

In some embodiments, the conducting extension has a frustoconical head portion and an indentation for conductively latching to a corresponding female conducting ring.

In some embodiments, the plurality of electrical connections is 10 separate electrical connections which are made via a combination of 9 male conducting rings and the conducting extension with 10 corresponding female conducting rings.

In some embodiments, the male component has an outer surface which includes a cylindrical portion with one end adjacent the conducting extension and its other end adjacent to the slope-stepped part.

In some embodiments, the slope-stepped part is formed of two slope-stepped portions, each having a different overall slope.

Another aspect of the invention is a rotary connector device for making a plurality of electrical connections in a mating arrangement between two components, the device comprising: a male component having an underlying body for holding a series of alternating male conducting rings and male insulating rings, the outer sidewalls of the male conducting rings and insulating rings providing an outer surface defining a large diameter end part transitioning to a slope-stepped part; and a female component having a central bore configured to retain a series of alternating female conductor rings and insulating rings, wherein each of the female conducting rings makes direct or indirect conductive contact with a corresponding male conducting ring of the male conducting rings when the mating arrangement is made, wherein each of the female conducting rings is connectable to an electrical line, wherein the male conducting rings and the female conducting rings, or separate conducting components associated therewith, have contact surfaces with complementary shapes that engage each other in a latching mechanism when the mating arrangement is made.

In some embodiments, the complementary shapes of the male conducting rings and the female conducting rings are provided by indentations in the male conducting rings and protrusions in the female conducting rings which are substantially complementary in shape to the indentations.

In some embodiments, the separate conducting components of the female conducting rings are conducting springs held within openings with circumferential cavities in the female conducting rings.

In some embodiments, the conducting springs are canted coil springs.

In some embodiments, the circumferential cavities are each defined by a five-sided polygonal inner sidewall defined by two opposed vertical walls connected to a horizontal floor by two angled walls.

In some embodiments, the male conducting rings each have circumferential indentations and the conducting springs provide convex surfaces complementary to the indentations of the male conducting rings, wherein mating of the convex surfaces to the indentations provides a compression force for the latching mechanism.

In some embodiments, the central bore is non-circular and the female conducting rings and female insulating rings are non-circular.

In some embodiments, the central bore is stadium-shaped and the female conducting rings and female insulating rings are stadium-shaped.

In some embodiments, the central bore has a sidewall with at least one transverse groove formed therein, for providing a channel for application of an adhesive for fixing the female conducting rings and female insulating rings in place during manufacture of the female component.

In some embodiments, the female conducting rings and the female insulating rings have outer slots providing passages for a plurality of electrical lines.

In some embodiments, the male component has a conducting extension configured to enter a matched recess in an insulating ring at the central bore's back end, wherein entry of the conducting extension into the matched recess serves to centralize the male component to provide consistent circumferential contact of the male conducting rings with corresponding female conducting springs.

In some embodiments, the conducting extension has a frustoconical head portion and an indentation for conductively latching to a corresponding female conducting ring.

In some embodiments, the plurality of electrical connections is 10 separate electrical connections which are made via a combination of 9 male conducting rings and the conducting extension with 10 corresponding female conducting rings.

In some embodiments, the male component has an outer surface which includes a cylindrical portion with one end adjacent the conducting extension and its other end adjacent to the slope-stepped part.

In some embodiments, the slope-stepped part is formed of two slope-stepped portions, each having different slopes formed by the male insulating rings.

In some embodiments, the underlying body of the male component is defined by a plurality of channels for separately holding wires for making the electrical connections.

BRIEF DESCRIPTION OF THE DRAWINGS

Various objects, features and advantages of the invention will be apparent from the following description of particular embodiments of the invention, as illustrated in the accompanying drawings. The drawings are not necessarily to scale in all cases. Instead emphasis is being placed upon illustrating the principles of various embodiments of the invention. Similar reference numerals indicate similar components.

DETAILED DESCRIPTION OF THE INVENTION

Rationale

Figure 1:
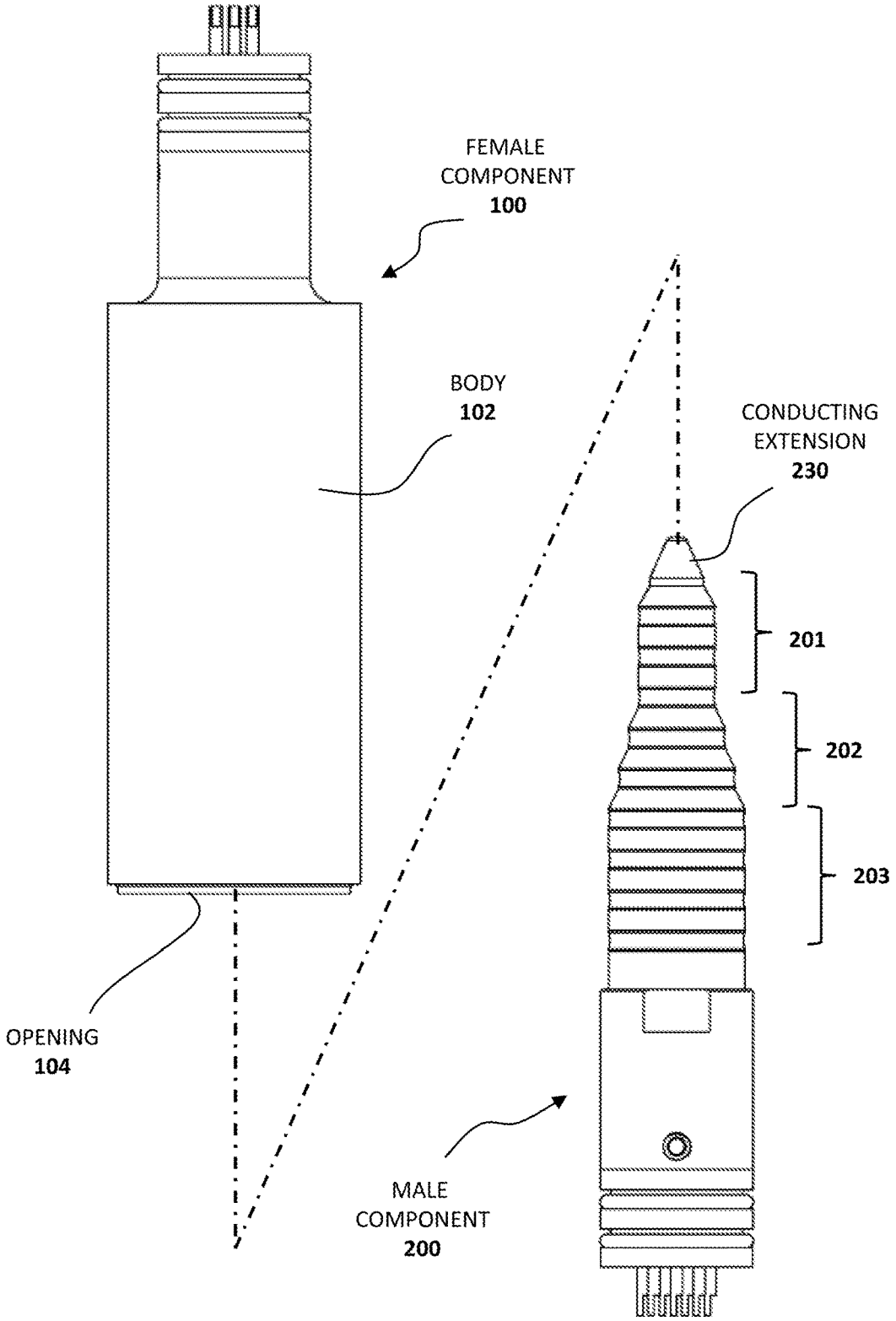
FIG. 1 is a partially exploded view showing the manner of connection of the female 100 and male 200 components of a connector device according to embodiment 1 of the invention.

As described above, a number of electrical connectors have been designed for use in harsh environments where a plurality of electrical connections is required to provide high currents and low resistance. The harsh conditions encountered may include high temperatures, significant vibrations and contact with or immersion in liquids.

Problems encountered with existing electrical connector devices include damage caused by high temperatures, repeated assembly/disassembly iterations causing premature failures, intermittent connections from poorly aligned mating surfaces resulting from segmented construction, and poor mechanical tolerances. Inadequate waterproofing and foreign gas or liquid exposure damages as well as extended period vibration also cause premature failures. Assembly of these existing connector devices tends to be labor-intensive with numerous parts and process steps. In many cases, an assembled connector device is inserted into an auxiliary housing which is held in compression to keep the two connector halves together under vibration. Connection spring material, gold plating, and material selection have been used to improve connector longevity. Manual assembly has been a problem that increases the costs of existing connector devices.

The connector device of the present invention has been designed to address a number of the problems encountered with existing connector devices, by providing a perpendicular 360 degree mating surface in a slope-stepped contact design. Complementary electrical contact surfaces between the male and female components are shaped to cooperate in providing a latching mechanism to secure the connector in an alignment suitable to hold the connector concentrically in place and minimize resonant harmonics during vibration by maintaining a stabilized connection along the center axis. The addition of seals keeps out foreign particles and liquids. Assembly time has been improved using a small part count, integrated components, simpler machining, and a simpler assembly process.

Definitions

As used herein, the term "slope-stepped" is used to describe a shape formed of a sloped surface joining a relatively flat surface or an indented or concave surface.

As used herein, the term "ball detent" refers to a mechanical arrangement used to hold a moving part in a fixed position relative to another part. The ball detent arrangement is provided by an indentation, concave surface or hole into which part of a rounded component drops to hold the parts in the fixed position relative to each other.

As used herein, the term "ring" refers to a rounded part with a central opening. The ring need not be strictly circular. In preferred embodiments described herein, the ring is elliptical, ovoid or stadium-shaped with a central circular opening.

As used herein, the term "complementary" refers to a relationship between parts which combine to form a complement, which in the present invention is a combination of surfaces of separate parts which form a latched arrangement.

Various aspects of the invention will now be described with reference to the figures. For the purposes of illustration, components depicted in the figures are not necessarily drawn to scale. Instead, emphasis is placed on highlighting the various contributions of the components to the functionality of various aspects of the invention. A number of possible alternative features are introduced during the course of this description. It is to be understood that, according to the knowledge and judgment of persons skilled in the art, such alternative features may be substituted in various combinations to arrive at different embodiments of the present invention.

Overview of Connector Device

In general terms, the device of the present invention includes a female component and a male component configured to make a plurality of electrical connections when these two components are mated. In order to make these electrical connections, a series of electrical leads are connected to feed-through connectors at the back ends of the two components according to known arrangements. The electrical leads pass through the bodies of the two components and make contact with electrically conducting rings. When the components are in the mated arrangement, the electrically rings of the male component make either direct or indirect conducting contact with the electrically conducting rings of the female component, thereby forming a connection which allows electrical current to flow across the device.

The connector device of the present invention, which includes a generally cylindrical slope-stepped male component, was designed to be mated during rotation and is not damaged by rotation. The connector integrates a latching mechanism which may be described as similar to a mechanical "ball detent" mechanism in which a rounded protrusion on one component drops into a hole or depression in a second component to connect the two components. The connector device of the present invention provides a positive substantially perpendicular electrical connection with mechanical resistance to prevent disconnection.

Uses in industrial applications include aeronautics, plenum cables, energy plants, telemetry cables, hydrocarbon production, and anywhere a reliable low maintenance connection is required with high current, low resistance, high reliability in harsh environments, as well as any application requiring blind mating without a mechanical bayonet of twist escutcheon. Underwater connections are possible with provision of existing external pressure rated protective housings.

DESCRIPTION OF EXAMPLE EMBODIMENTS

Embodiment 1

A first embodiment of the connector device of the invention will now be described with reference to FIGS. 1 to 9. Alternative features are described during the course of description of this and other embodiments. The skilled person will recognize that various alternative features are combinable to produce a number of alternative embodiments when combinations are compatible as readily recognized by the skilled person. Such alternative embodiments are also within the scope of the invention as defined by the appended claims.

Referring now to FIG. 1, there is shown a partially exploded view of one embodiment of the entire device showing the manner of connection of the female component 100 with the male component 200. Features associated with the female component 100 and the male component 200 are described in subsequent figures using reference numerals in the 100 series for female component features and in the 200 series for male component features. Separate components identified using the same reference numeral with different accompanying letters (e.g. 132*a*, 132*b*) indicate a plurality of substantially identical components.

In FIG. 1, it is seen that the male component 200 is inserted into the opening 104 of the cylindrical hollow body 102 of the female component 100 with the frustoconical conducting extension 230 of the male component 200 extending toward the back of the female component 100. In addition to the conducting extension 230, the male component 200 has three main insertion parts; a cylindrical small diameter part 201 adjacent to the conducting extension 230, an intermediate slope-stepped part 202 whose diameter increases away from the small diameter part 201 and a cylindrical larger diameter end part 203. The purpose of providing a varying the diameter of the male component 200 is to facilitate proper alignment of the male component 200 during its insertion into the female component 100.

Additional features of the assembly of the female component 100 and the male component 200 are shown in cross section in FIGS. 9A to 9C and are described in more detail hereinbelow with regard to the latching mechanism.

Features of the Female Component of Embodiment 1

Figure 2A:
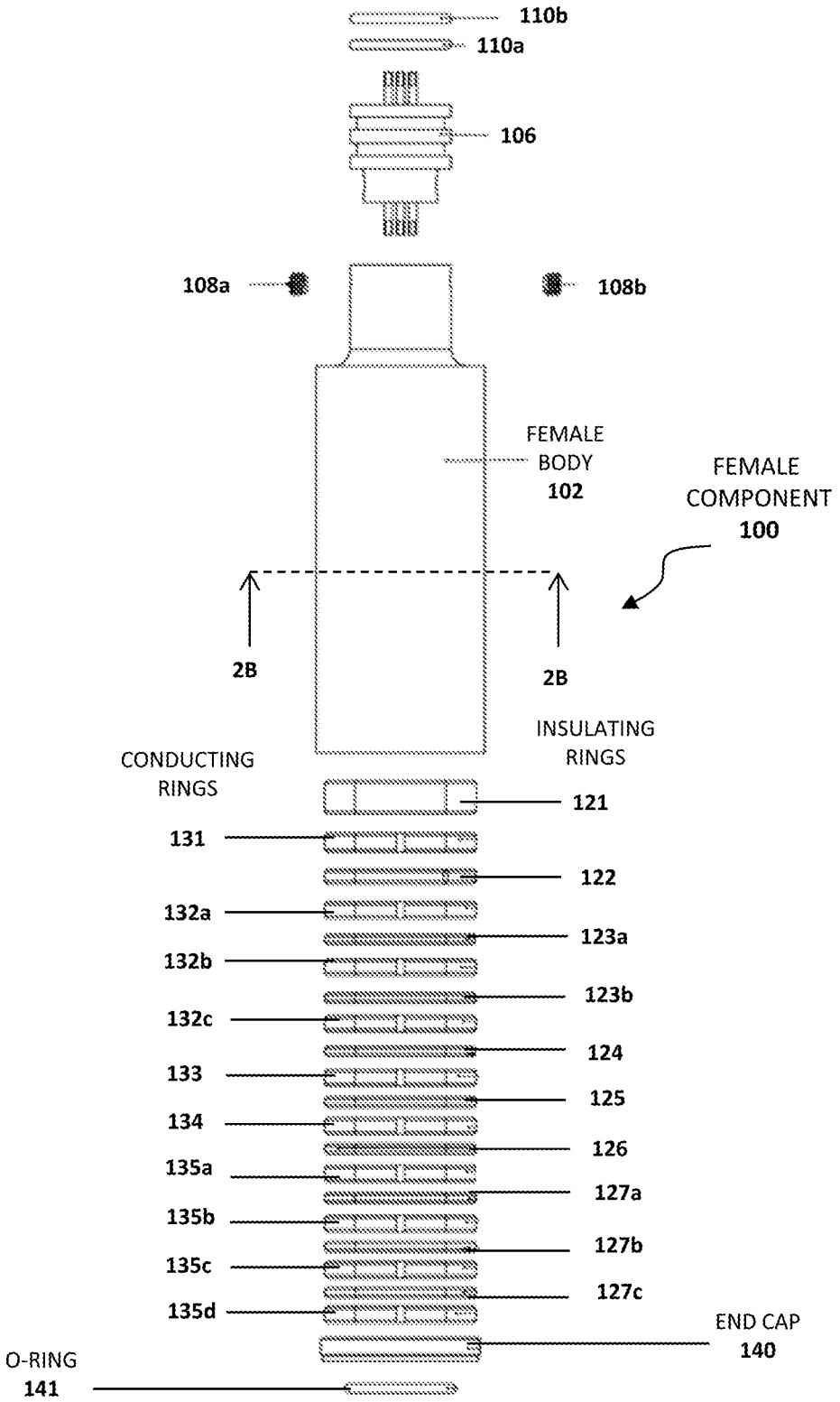
FIG. 2A is an exploded view of the female component 100 of the embodiment of FIG. 1.
Figure 2B:
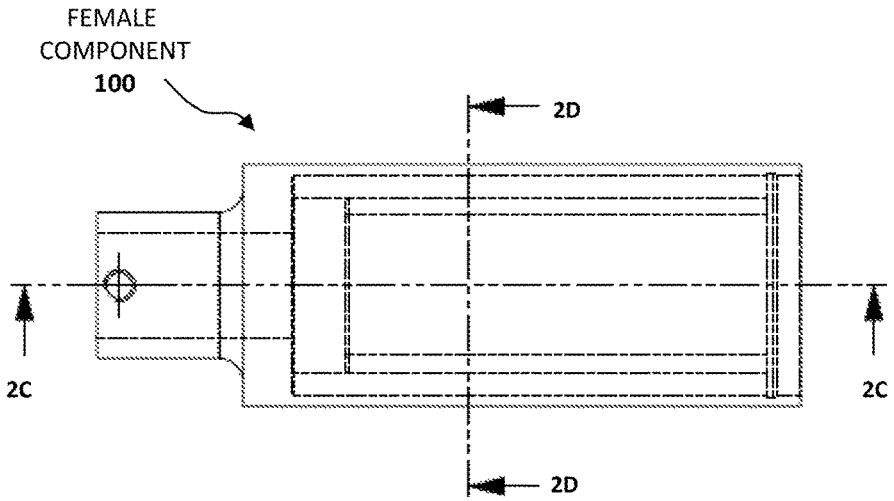
FIG. 2B is a side elevation view of the female component 100 of the embodiment of FIG. 1 with locations of inner walls shown with dashed lines.
Figure 2C:
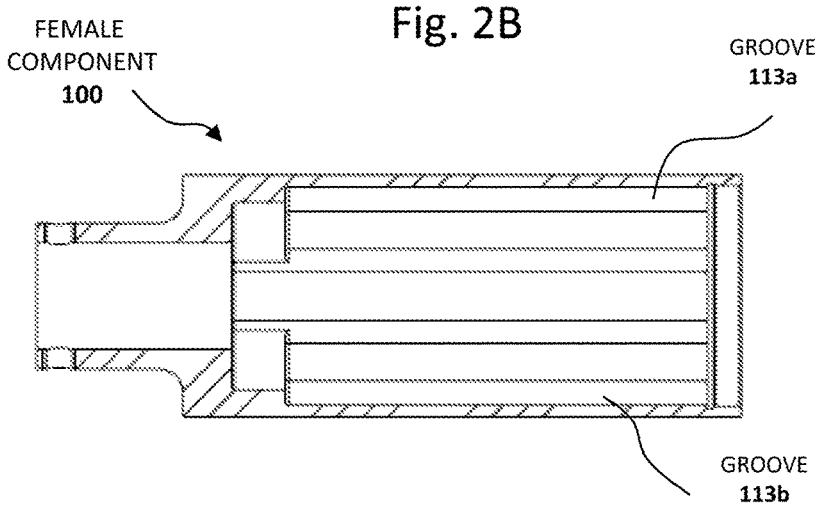
FIG. 2C is a cross section of the female component 100 taken along line 2C-2C of FIG. 2B.
Figure 2D:
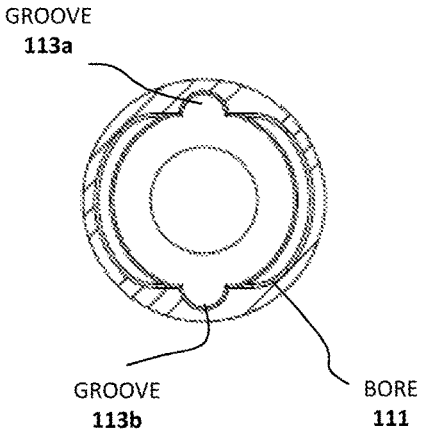
FIG. 2D is a cross section of the female component 100 of FIG. 2A taken along line 2D-2D of FIG. 2B.
Figure 3:
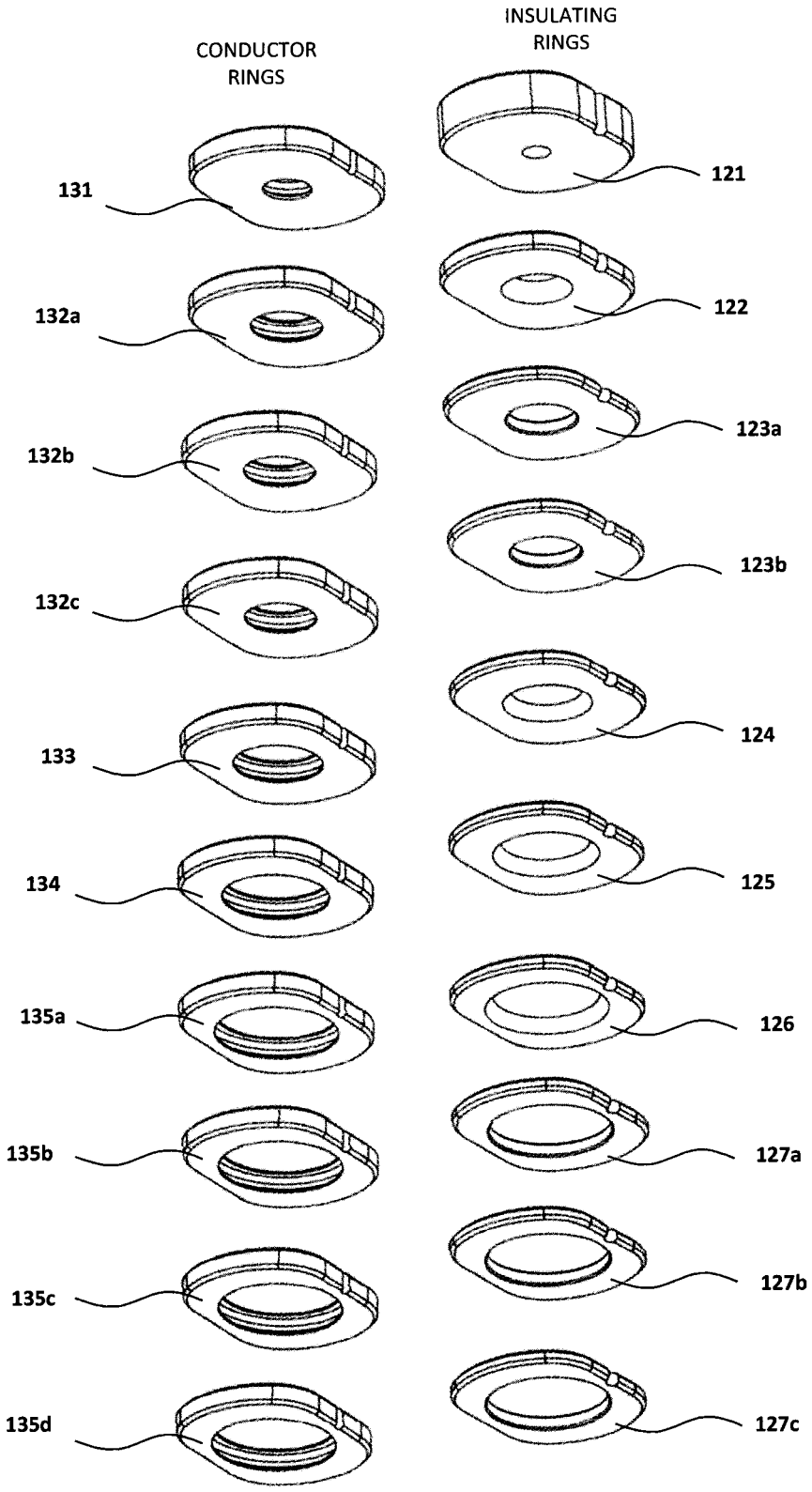
FIG. 3 is a perspective view of the series of conducting rings and insulating rings of the female component 100.

FIGS. 2 to 4 illustrate features of the female component 100. FIG. 2A is an exploded view of the female component 100 with the conducting wires omitted to preserve clarity. The female component 100 has a stack of alternating insulating rings 121, 122, 123*a* 123*b*, 124, 125, 126, 127*a*, 127*b* and 127*c* and conducting rings 131, 132*a*, 132*b*, 132*c*, 133, 134, 135*a*, 135*b*, 135*c*, and 135*d* occupying the central bore 111 (see FIG. 2D) of the body 102 of the female component 100 and also includes a threaded end cap 140 with an o-ring 141 providing a seal (more detail regarding the structures of the insulating and conducting rings is shown in the perspective views in FIG. 3). The opposite end of the female component 100 has an opening to accommodate a feed-through connector 106 which is fixed to the body 102 of the female component 100 by a pair of screws 108*a* and 108*b*. Additional o-rings 110*a* and 110*b* provide seals for the feed-through connector 106.

Cross sectional views of the body 102 of the female component 100 are shown in FIGS. 2C and 2D. It is seen that the shaped bore 111 is generally stadium-shaped and includes a pair of opposing radiused longitudinal grooves 113*a* and 113*b*. The stadium-shaped bore 111 is provided in combination with stadium-shaped female insulating rings and conducting rings which are described in more detail with respect to FIG. 3. The stadium shape prevents rotation of these insulating rings and conducting rings within the bore 111. The longitudinal grooves 113*a* and 113*b* provide channels for the wires to extend through the female body 102 for connection to individual conducting rings, as well as providing space for injection of an adhesive to fix the insulating rings and conducting rings to the inner sidewall of the bore 111 during the process of manufacture of the female component (described in more detail hereinbelow). In one particular embodiment, all ten of the wires connected to the female conducting rings are located in only one of the two longitudinal grooves 113*a,b*.

Shown in FIG. 3 are offset stacks of stadium-shaped insulating rings 121, 122, 123*a*, 123*b*, 124, 125, 126, 127*a*, 127*b* and 127*c* and conducting rings 131, 132*a*, 132*b*, 132*c*, 133, 134, 135*a*, 135*b*, 135*c*, and 135*d*. To facilitate an understanding of this example embodiment, it is to be understood that rings with the same base reference numeral are substantially identical. In particular, the openings of the rings have substantially identical diameters. Therefore, conducting rings 132*a*, 132*b* and 132*c* are substantially identical and conducting rings 135*a*, 135*b*, 135*c* and 135*d* are substantially identical. Conducting rings 131, 133 and 134 each have unique structures defined by openings with unique diameters. This same convention is followed for the set of insulating rings 121, 122, 123*a*, 132*b*, 124, 125, 126, 127*a*, 127*b* and 127*c*.

Alternative embodiments employ a female bore with a different shape which preferably is not strictly circular. Having a non-circular bore prevents rotation of the conducting and insulating rings held therewithin. Alternative bore shapes thus may include oval-shaped bores, elliptical-shaped bores, square bores and polygonal shaped bores.

Figure 4A:
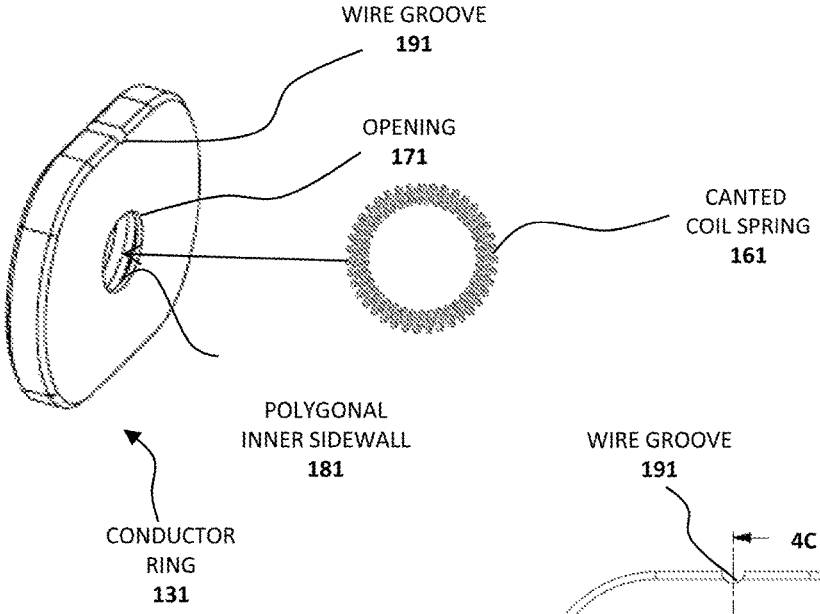
FIG. 4A is a perspective view of conducting ring 131 indicating that a canted coil spring 161 is inserted into the opening 151.
Figure 4B:
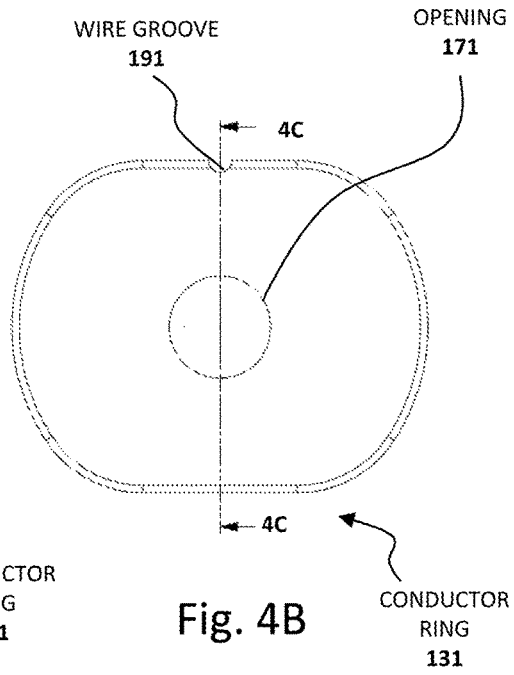
FIG. 4B is a plan view of conductor ring 131.
Figure 4C:
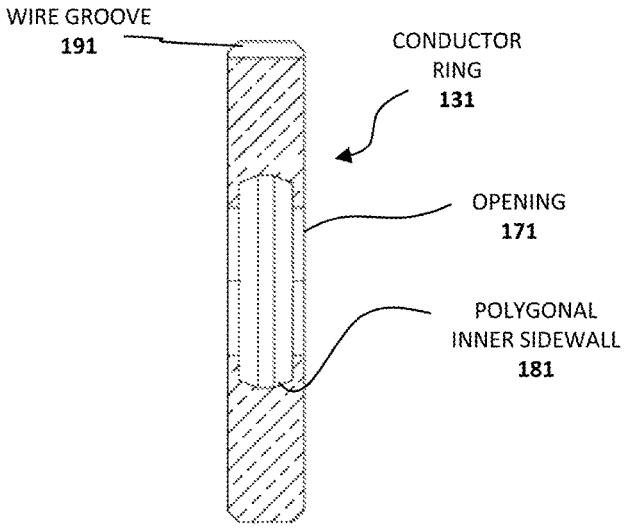
FIG. 4C is a cross section of conductor ring 131 taken along line 4C-4C of FIG. 4B.
Figure 5A:
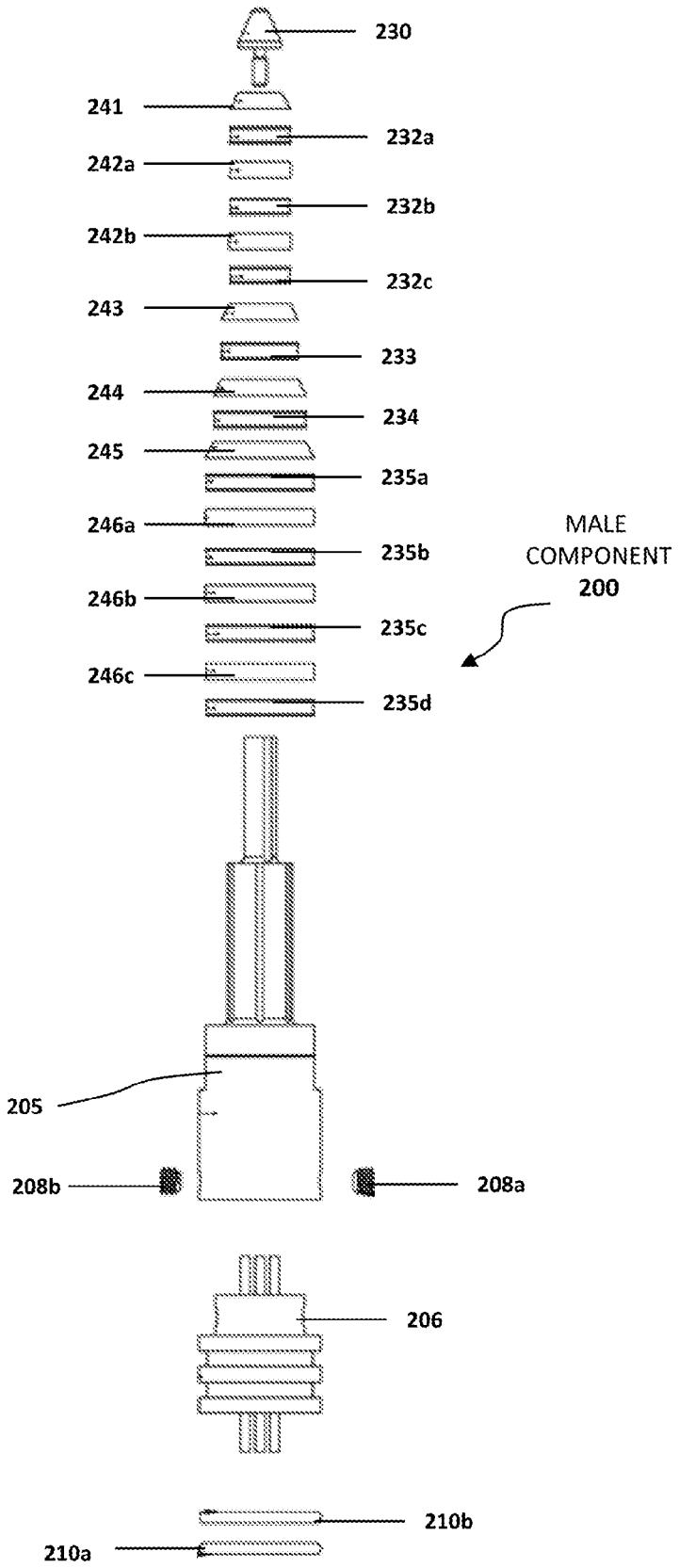
FIG. 5A is an exploded view of the male component 200 of the embodiment of FIG. 1.
Figure 5B:
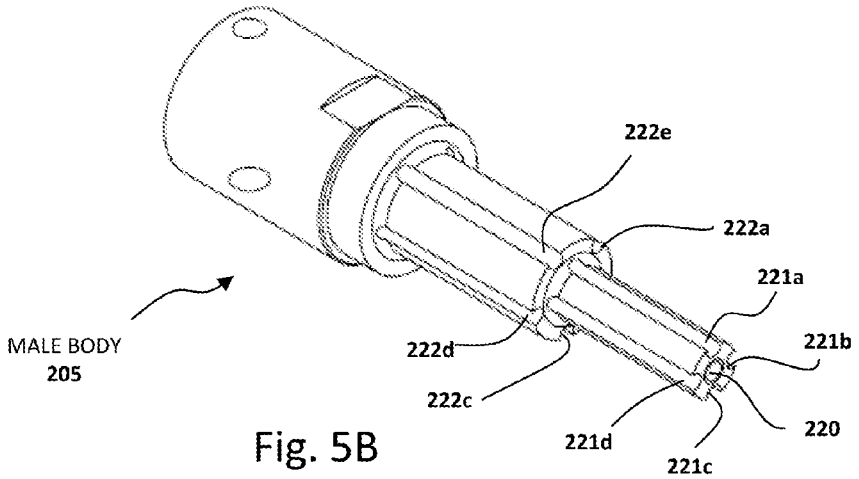
FIG. 5B is a perspective view of the body of the male component 200 without the male conductor rings, conical extension and male insulator rings showing detail of conducting wire channels.
Figure 5C:
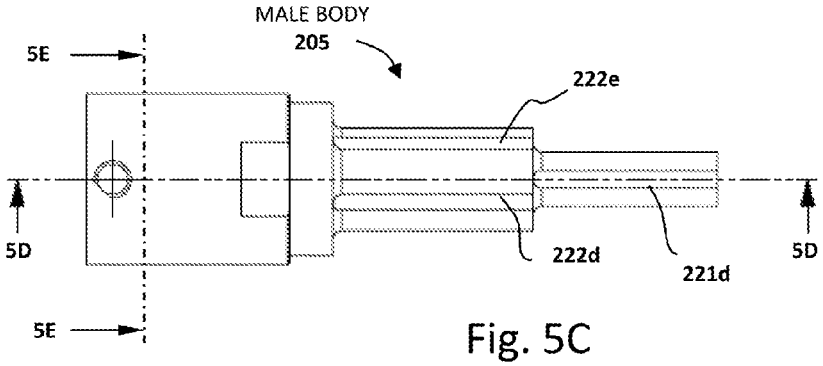
FIG. 5C is a side elevation view of the male component 200 without the male conductor rings, conical extension and male insulator rings showing detail of conducting wire channels.
Figure 5D:
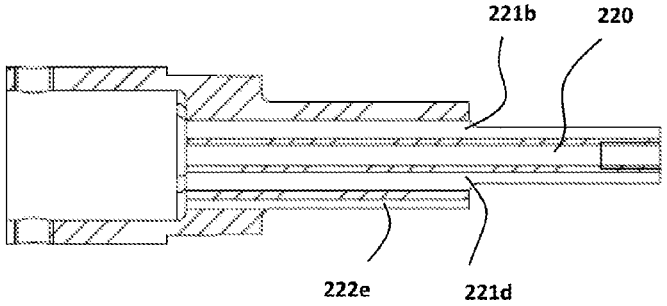
FIG. 5D is a cross sectional view taken along line 5D-5D of FIG. 5C.
Figure 5E:
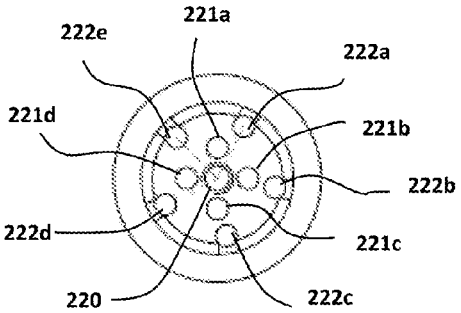
FIG. 5E is a cross sectional view taken along line 5E-5E of FIG. 5C.

Turning now to FIGS. 4A to 4C, there is shown a series of views of conductor ring 131 to illustrate additional features of the conducting rings which all have the same general features with dimensions which vary according to their placement position along the length of the bore 111 female component 100. It is seen that conductor ring 131 has an opening 171 which is defined in this particular embodiment by a five-sided polygonal inner sidewall 181 defined by two opposed vertical walls connected to a horizontal floor by two angled walls. This shape is provided to enhance the conductivity between the conductor ring 131 and a conducting coil spring 161 placed therewithin. The five-sided polygonal sidewall 181 provides more surface area contact than a rectangular sidewall while being more easily manufactured than a matching radiused sidewall (the circular insets of FIGS. 9B and 9C show in cross section how one coil of a coil spring 162*b* occupies the polygonal sidewall 182*b*).

Returning now to FIGS. 4A to 4C, it is seen that in this particular embodiment, a continuous outer curved sidewall of conductor ring 131 has a groove 191 formed therein to allow connection of electrical lead wires. The insulation of the wire is stripped sufficiently to place the bare wire in the groove 191 and the remainder of the wire extends to the back of the female component 100. In this manner, each of the female conducting rings is connected to a designated wire and the plurality of wires extend to the back of the female component 100 within one or both of the longitudinal grooves 113*a* and 113*b*.

In certain embodiments, the coil spring is a canted coil spring. One example of a canted coil spring design is the Bal Spring™ canted coil spring manufactured by Bal Seal Engineering Inc. of Foothills Ranch, Calif., USA; http://www.balseal.com/springs, incorporated herein by reference in its entirety). The spring's independent coils serve as multiple contact points for optimal conductivity and provide consistent reliable connections under shock and vibrations and also provide a means for mechanically fastening one part to another with precisely controllable insertion and removal forces.

Features of the Male Component of Embodiment 1

Features of the male component are shown in FIGS. 5 to 8 with conducting wires omitted to preserve clarity. FIG. 5A is an exploded view of the male component 200. The underlying male body 205 has a stepped structure and is connected to a male feed-through connector 206 by a pair of screws 208*a* and 208*b*. The feed through connector 206 is sealed with a pair of o-rings 210*a* and 210*b*. A series of alternating conducting rings and insulating rings is placed over the stepped structure of the male body 205. Alternating conducting rings 232*a*, 232*b* and 232*c* and insulating rings 241, 242*a* and 242*b* form the outer surface of the small diameter part 201. Alternating conducting rings 233 and 234 and insulating rings 243, 244 and 245 form the outer surface of the middle portion to form the slope-stepped intermediate part 202. Alternating conducting rings 235*a*, 235*b*, 235*c* and 235*d* and insulating rings 246*a*, 246*b*, and 246*c* form the larger diameter end part. A conducting extension 230 is placed adjacent to the insulating ring 241.

FIGS. 5B, 5C, 5D and 5E provide views of the male component body 205 with the insulating rings, conducting rings and conducting extension removed to show additional features. The tip end portion has an opening to a channel 220 which is configured to receive the stem part 239 of the conducting extension 230 (see FIG. 6). The channel 220 is provided to hold the wire designated for electrical connection at the conducting extension 230. Four equi-spaced channels 221*a*, 221*b*, 221*c* and 221*d* are formed around the circumference of the tip part of the body 205 and extend back through the remainder of the body 205 for separately holding four wires that connect to the conducting rings 232*a*, 232*b*, 232*c* and 233. Likewise, there are five equi-spaced channels 222*a*, 222*b*, 222*c*, 222*d* and 222*e* formed in the middle part of the body 205 for separately holding five wires that connect to the conducting rings 234, 235*a*, 235*b*, 235*c* and 235*d*. The provision of a separate channel for each of the ten electrical leads associated with the male component 200 allows the ten electrical leads to be separated from each other and reduces the likelihood of electrical shorting. As noted above, the conducting male wires are omitted to preserve clarity.

Figure 6:
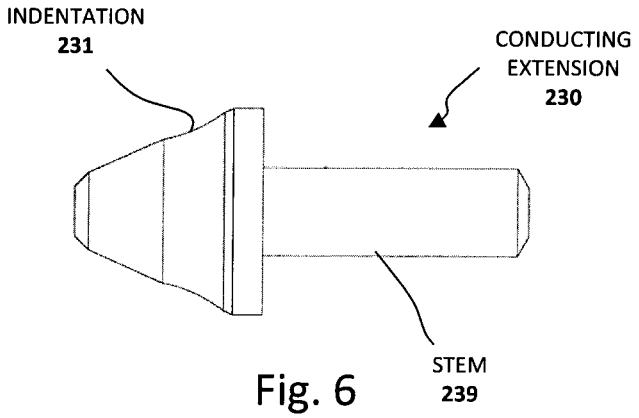
FIG. 6 is a side elevation view of the conducting extension 230 showing its circumferential indentation 231 and stem 239.

FIG. 6 shows additional detail of the conducting extension 230, indicating that it has a circumferential indentation 231 that plays a role in the latching mechanisms described hereinbelow. It is to be understood that the stem 239 of the conducting extension 230 is inserted into channel 220 after the alternating male insulating rings and male conducting rings are placed on the male body 205. In this particular embodiment, the head of the conducting extension is generally frustoconical-shaped. Alternative embodiments have a generally conical shape or a generally cylindrical shape. Alternative embodiments of the conducting extension have a perpendicular step consisting of a vertical drop adjacent to a generally flat surface instead of a sloped indentation as shown in FIG. 6. This arrangement is formed in the frustoconical-shaped conducting extension.

Figure 7A:
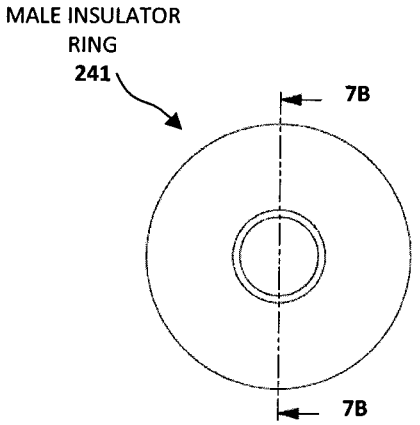
FIG. 7A is an elevation view of male insulator ring 241.
Figure 7B:
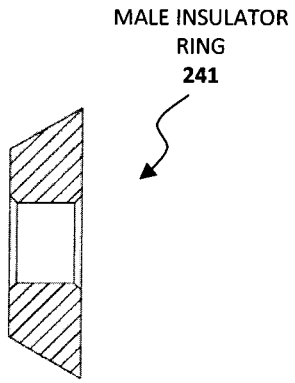
FIG. 7B is a cross sectional view taken along line 7B-7B of FIG. 7A.

FIGS. 7A and 7B provide views of male insulator ring 241 as an example of a male insulator ring. It is seen that this particular insulator ring is frustoconical in shape to provide general continuity with the frustoconical shape of the head of the conducting extension 230. Likewise, insulator rings 243, 244 and 245 are also frustoconical for the purpose of providing the intermediate slope-stepped part 202 of the male component 200. The remaining male insulator rings, rings 242*a*, 242*b*, 246*a*, 246*b* and 246*c* are generally cylindrical.

Figure 8A:
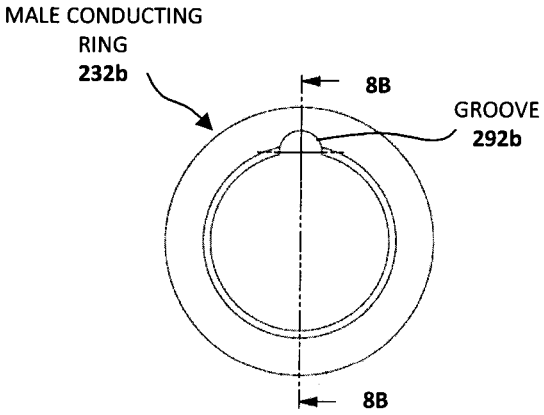
FIG. 8A is an elevation view of male insulator ring 232*b*.
Figure 8B:
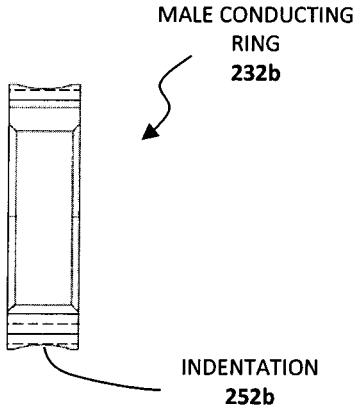
FIG. 8B is a cross sectional view taken along line 8B-8B of FIG. 8A.

FIGS. 8A and 8B provide views of male conducting ring 232*b*. This particular male conducting ring 232*b* is the focus of a description of the latching mechanism described with respect to FIGS. 9B and 9C hereinbelow.

FIG. 8A is a plan view showing a single groove 292*b* in the interior sidewall of the ring opening. This groove 292*b* is for placement and attachment of a corresponding lead wire by conventional soldering or electrically fusing, for example. FIG. 8B indicates that the outer sidewall of the male conducting ring 232*b* has a circumferential indentation

252*b*. It is to be understood that all of the male conducting rings 232*a*, 232*b*, 232*c*, 233, 234, 235*a*, 235*b*, 235*c* and 235*d* have similar circumferential indentations which contribute to the latching mechanism.

Embodiment 2

A second embodiment of the connector device of the invention will now be described with reference to FIGS. 10 to 16. As described above, the skilled person will recognize that various alternative features of this particular embodiment are combinable to produce a number of alternative embodiments when combinations are compatible as readily recognized by the skilled person. Such alternative embodiments are also within the scope of the invention as defined by the appended claims.

Figure 10:
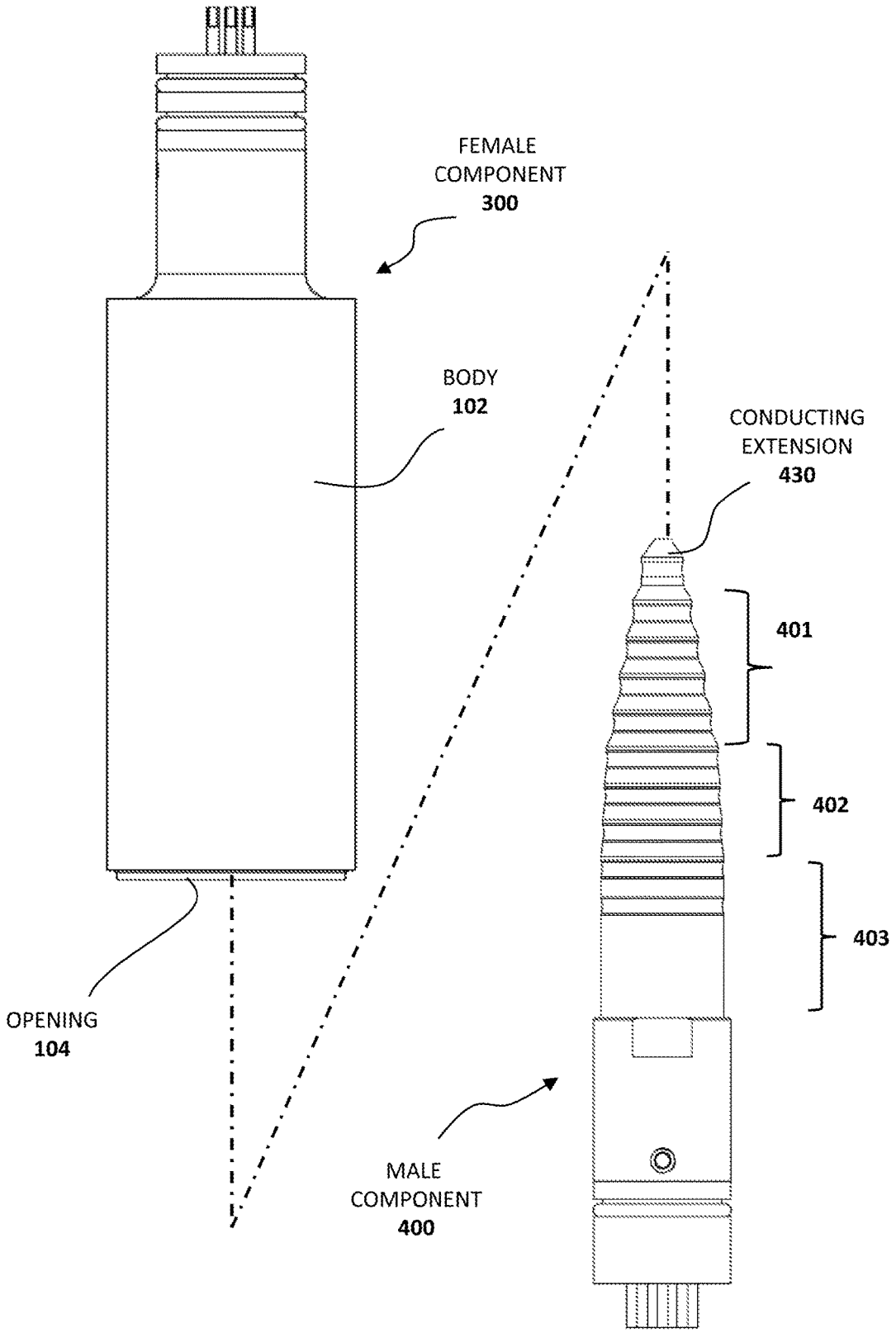
FIG. 10 is a partially exploded view showing the manner of connection of the female 300 and male 400 components of a connector device according to embodiment 2 of the invention.

Referring now to FIG. 10, there is shown a partially exploded view of one embodiment of the entire device showing the manner of connection of the female component 300 with the male component 400. Distinguishing features associated with the female component 400 and the male component 200 relative to the features of embodiment 1 are described in FIGS. 10-16 using reference numerals in the 300 series for female component features and in the 400 series for male component features. It is to be understood that embodiments 1 and 2 share a number of substantially identical features which will retain the same reference numerals used in the description of embodiment 1 in the ensuring description of embodiment 2. As described above, separate components identified using the same reference numeral with different accompanying letters (e.g. 339*a* and 339*b*) indicate a plurality of substantially identical components.

The primary difference in embodiment 2 relative to embodiment 1 relates to the shape of the outer surface of the male component 400 of embodiment 2, which requires complementary fitting against the insulating rings and conducting rings of the female component 300. This primary difference is conveniently provided by fitting the male component 400 with a series of conducting rings and insulating rings with different relative dimensions than those of embodiment 1. It follows that the series of conducting rings and insulating rings of the female component 300 which are configured to make contact with the conducting rings and insulating rings of the male component 400 must have different relative dimensions than those of embodiment 1, as described hereinbelow. Otherwise, all of the main structural support components of the female component 300 and the male component 400 are substantially identical and therefore need not be described in detail in this section.

In FIG. 10, it is seen that the male component 400 of embodiment 2 is inserted into the opening 104 of the cylindrical hollow body 102 of the female component 300 with the frustoconical conducting extension 430 extending toward the back of the female component 300 (the hollow body 102 and its opening 104 are substantially identical to those of embodiment 1 and therefore the same reference numerals are used). In addition to the conducting extension 430, the male component 400 has three main insertion parts; a steep slope-stepped part 401 adjacent to the conducting extension 430 whose diameter increases away from the conducting extension 430, a shallower slope-stepped part 402 whose diameter increases away from the small diameter part 401 and a cylindrical larger diameter end part 403. The purpose of varying the diameter of the male component 400 is to facilitate proper alignment of the male component 400 during its insertion into the opening 104 of the female component 300. One of the possible advantages of embodiment 2 over embodiment 1 is that having male conducting rings with progressively smaller diameters in the slope-stepped parts 401 and 402 reduces the likelihood of potentially undesirable temporary electrical connections being made as the male component 400 moves into the female component 400 during the process of connecting these two components. It is to be understood that the nature of the electrical connections being made will determine how important it is to avoid such undesirable electrical connections.

Features of the Female Component of Embodiment 2

Figure 11:
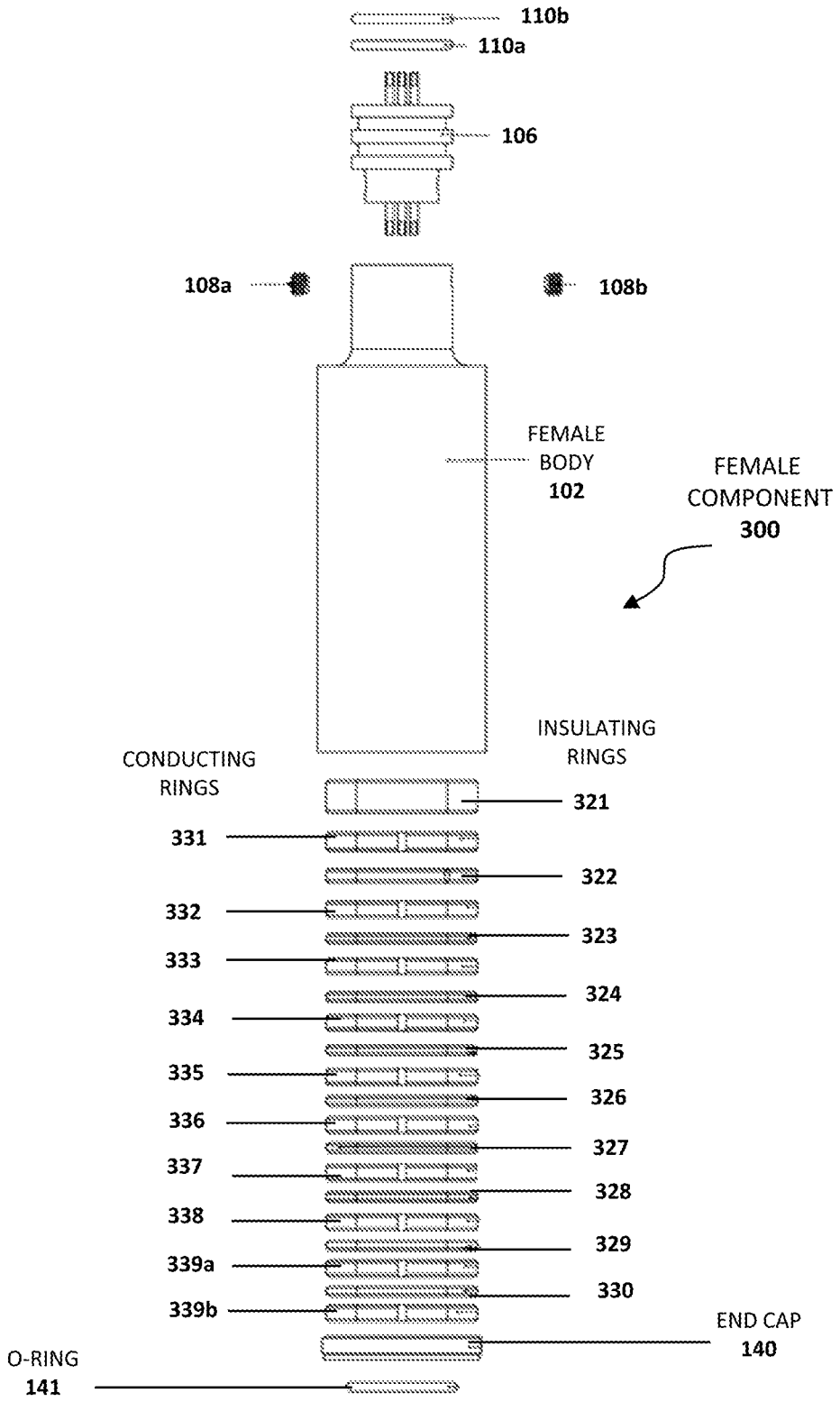
FIG. 11 is an exploded view of the female component 300 of the embodiment of FIG. 10.
Figure 12:
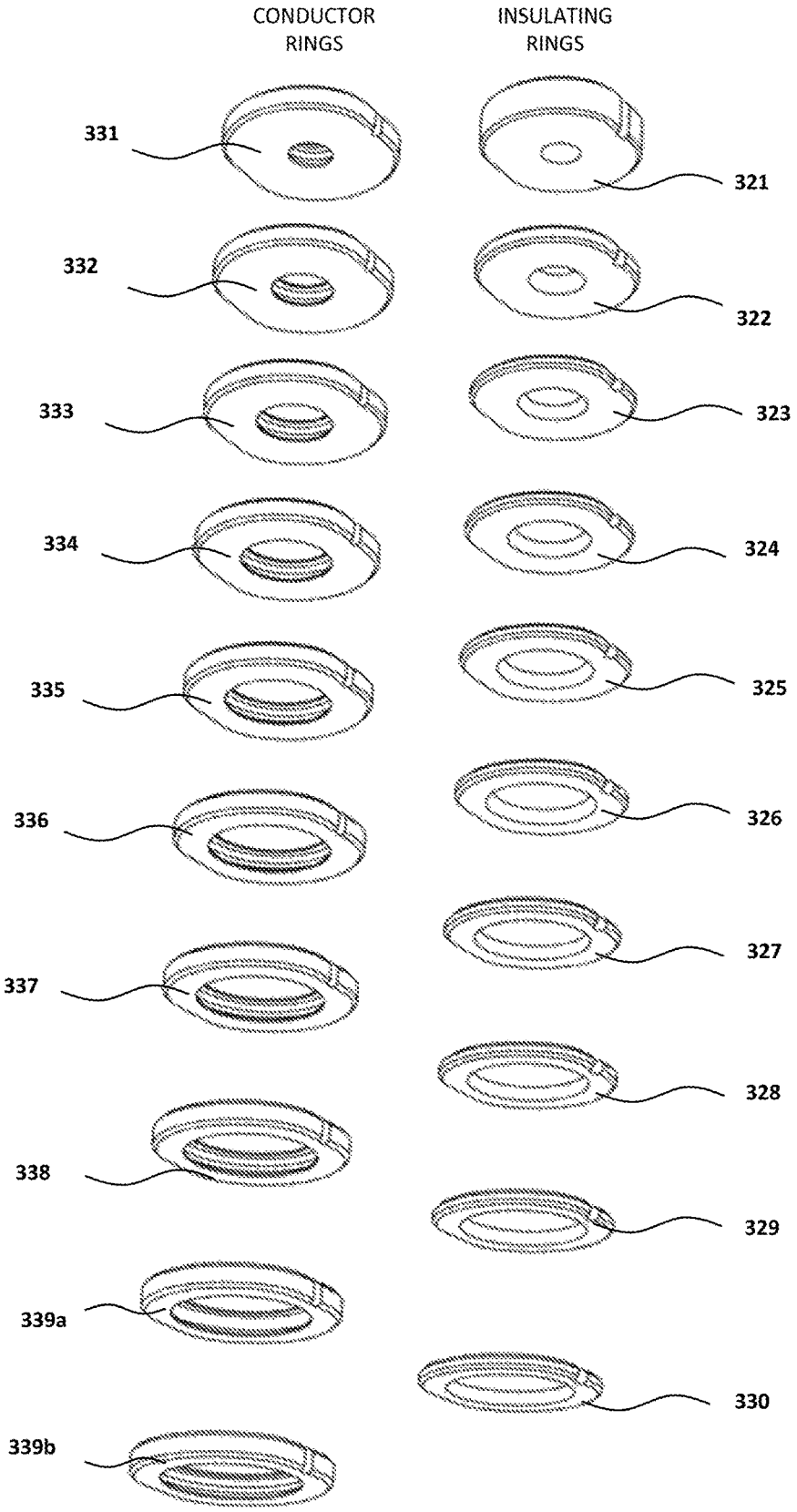
FIG. 12 is a perspective view of the series of conducting rings and insulating rings of the female component 300.

FIGS. 11 and 12 illustrate features of the female component 300. FIG. 11 is an exploded view of the female component 300 with the conducting wires omitted to preserve clarity, in a manner similar to the view of the female component 100 of embodiment 1 of FIG. 2A. It is seen in FIG. 11 that the female component 300 has a stack of alternating insulating rings and conducting rings which fit inside the central bore of the female body 102. However, these insulating and conducting rings have different relative dimensions than those of embodiment 1, to interact with the male component 400 which has a substantially different outer surface shape relative to from the male component 200 of embodiment 1. As such, each of the insulating rings 321, 322, 323, 324, 325, 326, 327, 328, 329 and 330 has a central opening with a different diameter and the conducting rings 331, 332, 333, 334, 335, 336, 337, 338 also each have a central opening with a different diameter while conducting rings 339*a* and 339*b* are substantially identical and have the same diameter. As described above for the female component 100 of embodiment 1, the female component 300 also includes a threaded end cap 140 with an o-ring 141 providing a seal. The opposite end of the female component 100 has an opening to accommodate a feed-through connector 106 which is fixed to the body 102 of the female component 100 by a pair of screws 108*a* and 108*b*. Additional o-rings 110*a* and 110*b* provide seals for the feed-through connector 106.

Shown in FIG. 12 are offset stacks of stadium-shaped insulating rings 321, 322, 323, 324, 325, 326, 327, 328, 329 and 330 and conducting rings 331, 332, 333, 334, 335, 336, 337, 338, 339*a* and 339*b*. As described above, it is to be understood that rings with the same base reference numeral are substantially identical. In particular, the openings of the rings have substantially identical diameters. Therefore, conducting rings 339*a* and 339*b* are substantially identical. The remaining conducting rings each have unique structures defined by openings with unique diameters.

As described above for embodiment 1, alternative embodiments employ a female bore with a different shape which preferably is not strictly circular. Having a non-circular bore discourages rotation of the conducting and insulating rings held therewithin. Alternative bore shapes thus may include oval-shaped bores, elliptical-shaped bores and polygonal shaped bores.

The other features of the conducting rings 331, 332, 333, 334, 335, 336, 337, 338, 339*a* and 339*b* are similar to the features illustrated in FIGS. 4A to 4C, and include an opening with the polygonal inner sidewall for holding a canted coil spring and a wire groove in the outer sidewall. These features have been described hereinabove with respect to FIGS. 4A to 4C and are thus not described further in context of embodiment 2.

Features of the Male Component of Embodiment 2

Figure 13:
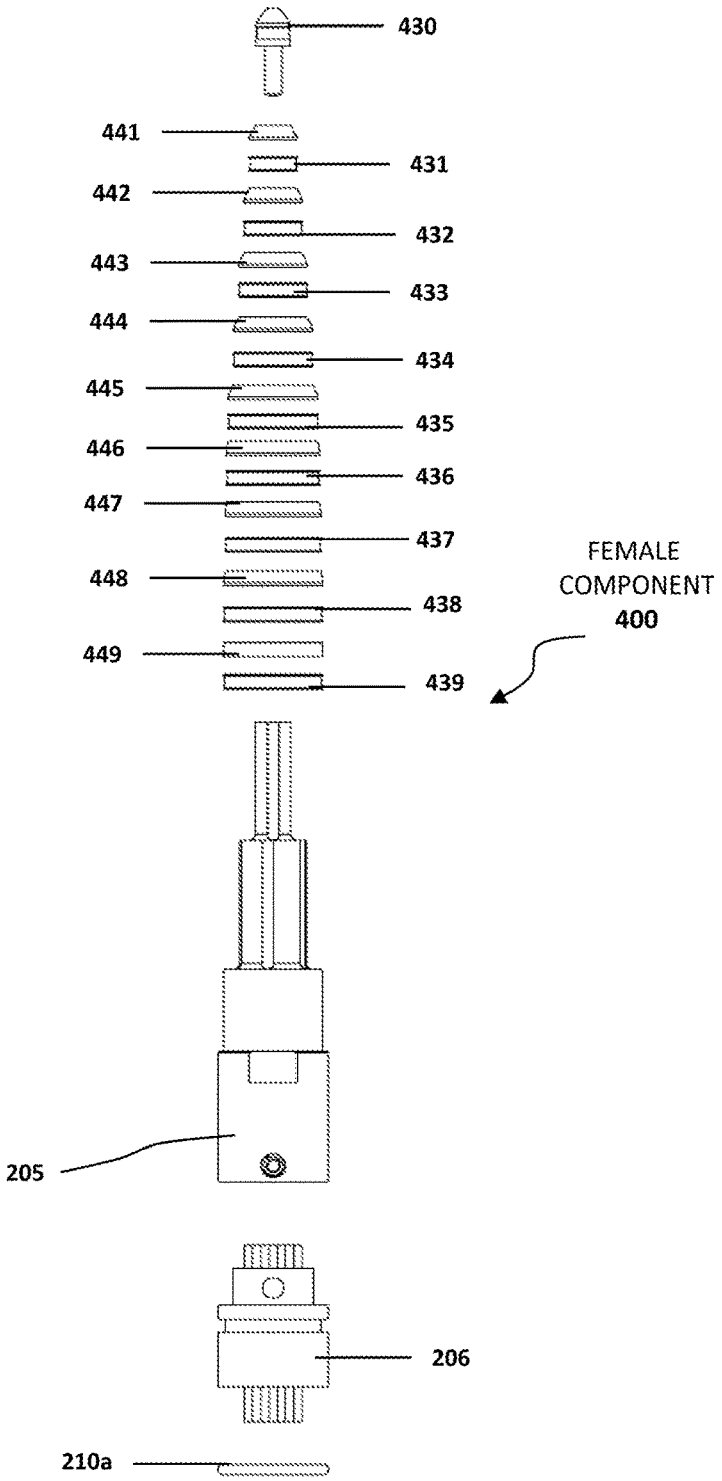
FIG. 13 is an exploded view of the male component 400 of the embodiment of FIG. 10.

Features of the male component are shown in FIGS. 13 to 15 with conducting wires omitted to preserve clarity. FIG. 13 is an exploded view of the male component 400. The underlying male body 205 is essentially identical to that of embodiment 1 and is connected to a male feed-through connector 206 (also substantially identical to that of embodiment 1) by a pair of screws 208*a* and 208*b*. The feed through connector 206 is sealed with a pair of o-rings 210*a* and 210*b* as in embodiment 1. A series of alternating conducting rings and insulating rings is placed over the stepped structure of the male body 205. As noted hereinabove, the male conducting rings and insulating rings are different from those of embodiment 1 to provide a different outer surface shape for this component. Alternating conducting rings 431, 432, 433 and 434 and insulating rings 441, 442, 443, 444 and 445 form the outer surface of the steep slope-stepped part 401. Alternating conducting rings 435, 436, and 437 and insulating rings 446, 447, 448 form the outer surface of the shallower slope-stepped portion to form the slope-stepped intermediate part 402. The outer surface of the cylindrical larger diameter end part 403 includes conducting rings 438 and 439 with intervening insulating ring 449. Insulating ring 449 has substantially the same diameter as the widest diameter portion of the male body 205. A conducting extension 430 is placed adjacent to the insulating ring 441 and is connected at its tip to the underlying male body 205 by a bolt or other similar fastener (not shown).

Figure 14A:
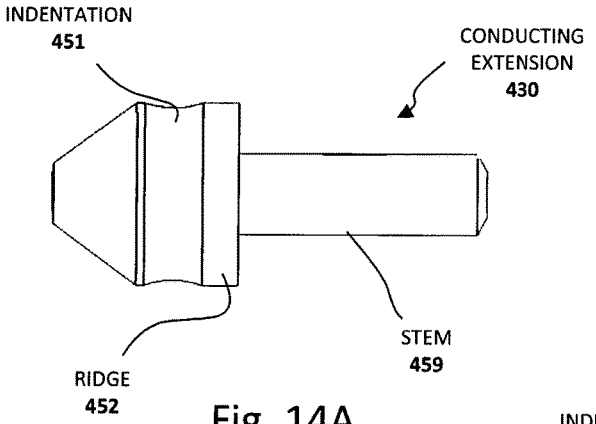
FIG. 14A is a side elevation view of a conducting extension 430 forming the tip of the male connector of the embodiment of FIG. 10.
Figure 14B:
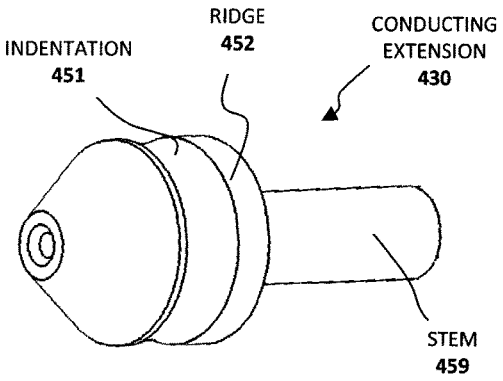
FIG. 14B is a perspective view of the conducting extension 430 of FIG. 14A.

FIGS. 14A and 14B show additional detail of the conducting extension 430, in a side elevation view and a perspective view, respectively, indicating that it has a circumferential indentation 451 that plays a role in the latching mechanisms described hereinbelow. It is seen that the indentation is formed in a substantially cylindrical portion of the conducting extension from the same level as a ridge 452 of consistent diameter which is located between the stem 459 and the indentation 451, in contrast to the conducting extension 230 of embodiment 1 (FIG. 6) which is on the slope of the frustoconical portion. The stem 459 of the conducting extension 430 is inserted into channel 220 of male body 205 (See FIG. 5B) as described above for conducting extension 230 of embodiment 1 after the alternating male insulating rings and male conducting rings are placed on the male body 205. In this particular embodiment, the head of the conducting extension 430 is generally frustoconical-shaped. As described above, alternative embodiments of the conducting extension have a generally conical shape or a generally cylindrical shape. Alternative embodiments of the conducting extension have been described above. All alternative embodiments of the conducting extension are compatible with embodiments 1 and 2 of the male component and as such, all combinations of male component embodiments and conducting extensions described herein are within the scope of the invention.

Figure 15A:
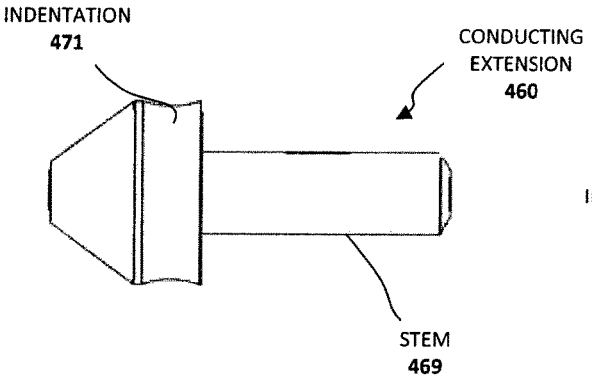
FIG. 15A is a side elevation view of an alternative embodiment of the conducting extension 460 which is compatible with the male connector of embodiment 1 and embodiment 2 as a replacement for conducting extension 230 or conducting extension 430.
Figure 15B:
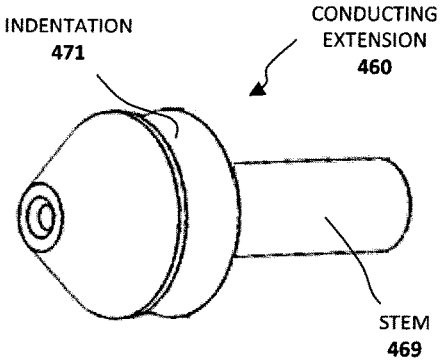
FIG. 15B is a perspective view of the conducting extension 460 of FIG. 15A.

An alternative conducting extension 460 is illustrated in FIGS. 15A and 15B in a side elevation view and a perspective view, respectively. This conducting extension 460 is applicable as a substitute for conducting extension 230 of the male component 200 of embodiment 1, and as a substitute for conducting extension 430 of the male component 400 of embodiment 2. The only difference in conducting extension 460 relative to conducting extension 430 is that the cylindrical ridge portion 452 of conducting extension 430 is absent in conducting extension 460. When conducting extension 460 is installed on the male component of embodiment 1 or embodiment 2, with its stem 469 placed into channel 220 of male body 205 (See FIG. 5B), the last insulating ring of the male series of insulating rings (insulating ring 241 in embodiment 1, and insulating ring 441 of embodiment 2) contacts the conducting extension 460 at the edge of its indentation 471.

It is to be understood that the male insulator rings of embodiment 2 differ from those of embodiment 1 with respect to their diameters and degree of slope (to form the slopes of the slope-stepped portions). The male conductor rings differ from those of embodiment 1 with respect to their diameters. As such, specific figures of the male insulating and conducting rings similar to those of FIGS. 7 and 8 for embodiment 1, are not shown for embodiment 2.

Figure 16A:
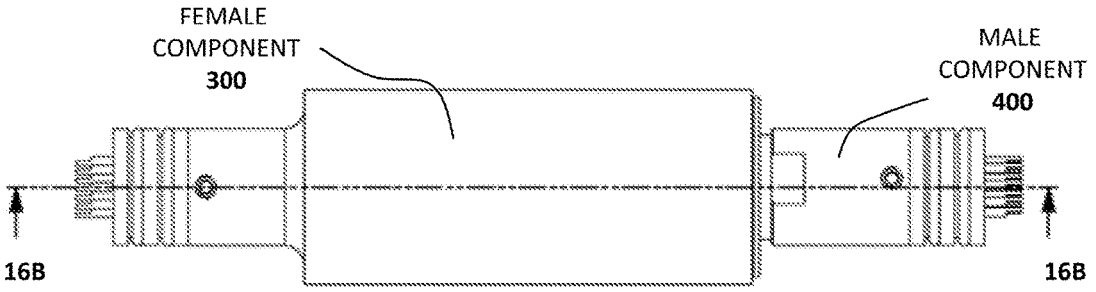
FIG. 16A is a side elevation view of the female component 300 mated with the male component 400 (embodiment 2).
Figure 16B:
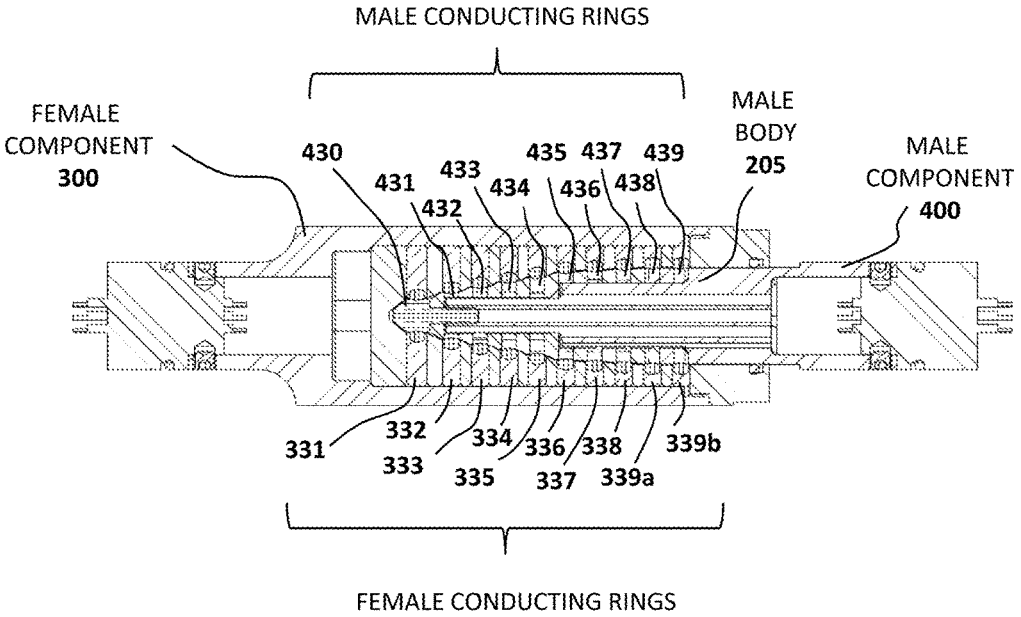
FIG. 16B is a side elevation view of the mated arrangement of FIG. 16A taken along line 16B-16B of FIG. 16A.

A side elevation view of the connected female 300 and male 400 components is shown in FIG. 16A and a cross section thereof is shown in FIG. 16B to illustrate how the female conducting rings 331, 332, 333, 334, 335, 336, 337, 338, 339*a* and 339*b* make contact with the male conducting extension 430 and conducting rings 431, 432, 433, 434, 435, 436, 437, 438 and 439. Operation of the latching mechanism for connecting the female and male conducting rings is substantially identical for embodiments 1 and 2 and is described directly below with respect to FIGS. 9A and 9B.

Latching Mechanism for Embodiments 1 and 2

Figure 9A:
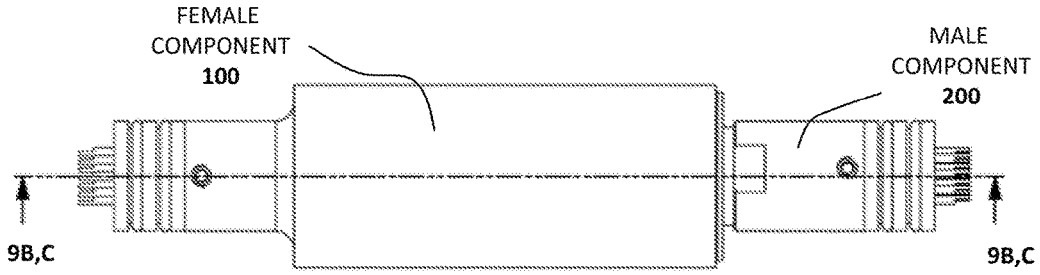
FIG. 9A is a side elevation view of the female component 100 mated with the male component 200 (embodiment 1).
Figure 9B:
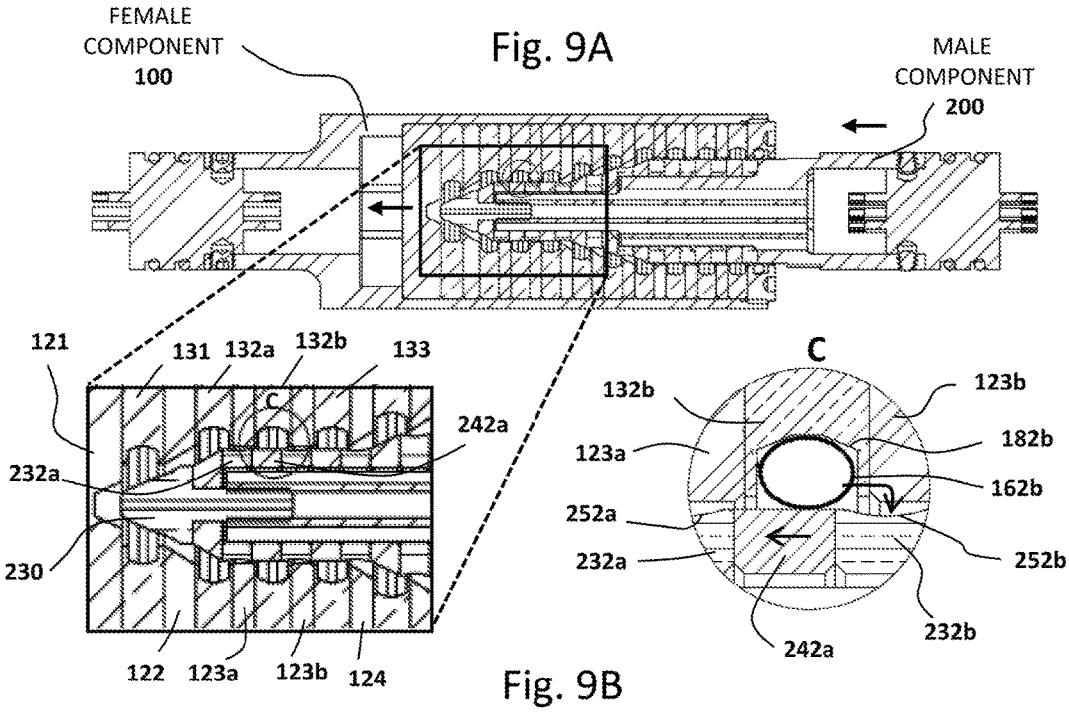
FIG. 9B is a cross sectional view taken along line 9B,C-9B,C of FIG. 9A (top) together with a magnified rectangular inset on the right and a further magnified circle C showing a cross section of a coil spring 162*b* resting upon a male insulating ring 242*a*. The straight arrows indicate the direction of movement of the male component when the connection is in the process of being made. The curved arrow shows how the coiled spring 162*b* drops into the indentation 252*b* of conducting ring 232*b*.
Figure 9C:
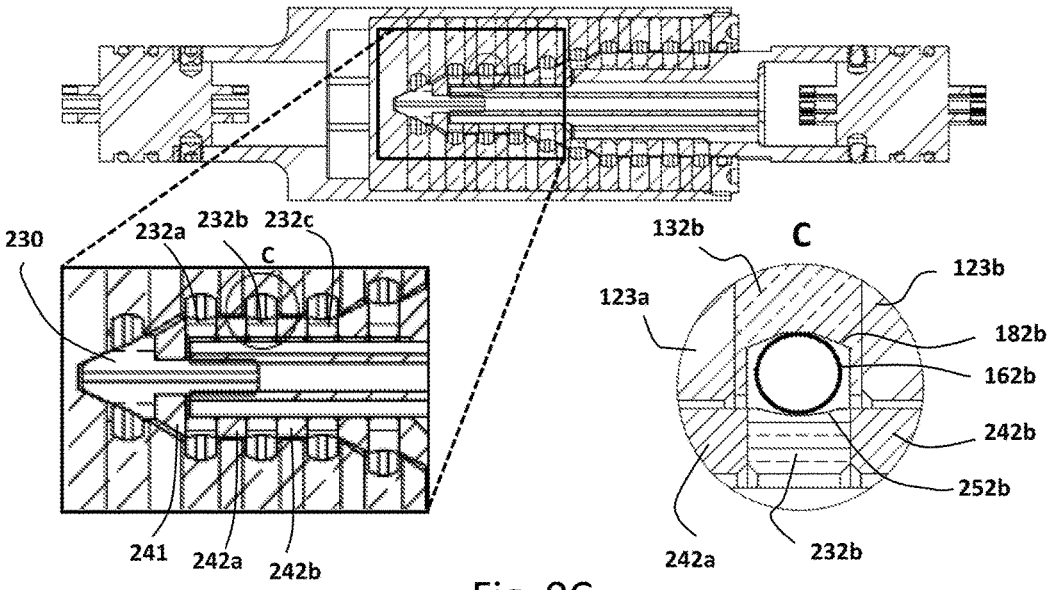
FIG. 9C is a cross sectional view taken along line 9B,C-9B,C of FIG. 9A (top) together with a magnified square inset on the right and a further magnified circle C on the left showing a cross section of a coil spring 162*b* in the latched position with the coil spring 162*b* nested within the indentation 252*b* of male conducting ring 232*b*.

FIGS. 9A to 9C show views of the assembly of the male and female components of embodiment 1 which is also applicable for describing the latching mechanism of embodiment 2 (as such, a corresponding set of drawings is not provided for embodiment 2). FIG. 9A is a side elevation view for the purpose of indicating cross sectional line 9B,C for FIGS. 9B and 9C.

The cross section of FIG. 9B shows the male component 200 just before it is completely inserted and latched and the cross section of FIG. 9C shows the same view when insertion and latching is complete. In FIG. 9B, the arrows show the direction of movement of the male component 200 to the left while the female component 100 remains stationary. The square inset is a magnification showing the conducting extension 230, the cylindrical tip part and the left side of the intermediate slope-stepped part. To preserve clarity, the conducting rings 131, 132*a*, 132*b* and 133 and insulating rings 122, 123*a*, 123*b* and 124 of the female component 100 are labelled in the square inset of FIG. 9B and the conducting rings 232*a*, 232*b* and 232*c* and insulating rings 241, 242*a* and 242*b* of the male component 200 are labelled in the square inset of FIG. 9C. The adjacent circular inset C is additionally magnified in FIGS. 9B and 9C and in FIG. 9B it is seen that the coil spring 162*b* which resides within the opening of female conductor ring 132*b* is compressed into an ovoid shape by virtue of its contact with the flat surface of the male insulator ring 242*a* and the polygonal inner sidewall 182*b* of the female conductor ring 132*b*. The polygonal inner sidewall 182*b* provides a shape approximating the compressed oval shape of the coil spring 162*b* to provide efficient conductivity between the coil spring 162*b* and the female conducting ring 132*b*.

In FIG. 9C, insertion and latching is complete and the coil spring 162*b* has dropped into the indentation formed by the concave surface 252*b* of the conducting ring 232*b*. It is also seen in the circular inset of FIG. 9C that the conducting spring 162*b* is less compressed than in FIG. 9B, but it is to be understood that it retains some compression force to hold the male conducting ring 232*b* in its latched position below the female conducting ring 132*b* such that electrical current flowing, between the male component 100 and the female component 200 will pass, for example, from a wire connected to male conducting ring 232*b*, through the conducting ring 232*b*, through coil spring 162*b*, through female conducting ring 132*b* to a wire connected to the female conducting ring 132*b*.

Manufacture of the Male and Female Components

Examples of the main manufacturing steps employed in the production of a general embodiment of the device of the present invention are described below. Additional steps may be included if deemed advantageous according to the judgement of the person skilled in the art.

Female Component—

The body of the female component is produced by injection molding according to conventional methods. In alternative embodiments, the body of the female component is produced by 3D-printing methods. Each of the ten insulated wires of the female component is cut to a length which allows it to extend from one of the female conducting rings through the bore to the back end of the female connector. In embodiments where a high pressure feed through connector is not required, each wire is cut to extend 12 inches past the end of the female component.

Both ends of each wire are tinned and soldered using high temperature solder. For connection of each wire to its corresponding female conducting ring, the wire is placed in the outer groove of a preheated corresponding conductor ring and solder is applied until it flows and forms a clean arc bond.

The conducting springs are then inserted into the inner openings of each of the female conducting rings and the stack of alternating conducting and insulating rings is assembled on a rod, ensuring that the orientation of the insulator rings is provided with the wider end towards back of the connector.

The stack of alternating conducting and insulating rings is transferred from the rod to the bore of the female component. The wires are routed through one of the longitudinal grooves formed in the bore until their cut ends extend through the feed through connector. A centralized stack of insulating and conducting rings is thus provided in the center of the female component. The end cap is threaded to the front of the female connector.

The female component is oriented with the opening of the bore facing upward and adhesive, such as an epoxy-based adhesive is poured into the longitudinal grooves formed in the bore. The adhesive settles around the entire stack but does not enter the inner conducting contact area. The female component is then subjected to vacuum to extract any entrained air in the connector body. More adhesive is added and the process is repeated until the connector is filled with adhesive. The female component is then heated to cure the adhesive and fix the wires and the stack of conducting and insulating rings in place and the end o-ring adjacent the bore is positioned in the end cap. In embodiments where the female component includes a high pressure feed through connector at its back end, this connector is connected at this point in the manufacturing process and fixed in place with screws and adhesive according to known methods.

Male Connector—

The body providing the underlying structure of the male component is manufactured by injection molding according to conventional methods. In alternative embodiments, the body of the male component is produced by 3D-printing methods. Each of the ten insulated wires of the male component is cut to a length which allows it to extend from one of the male conducting rings through the bore to the back end of the male component. In embodiments where a high pressure feed through connector is not required, each wire is cut to extend 12 inches past the end of the male component.

Both ends of each wire are tinned and soldered using high temperature solder. For connection of each wire to its corresponding female conducting ring, the wire is placed in the outer groove of a preheated corresponding conductor ring and solder is applied until it flows and forms a clean arc bond.

The series of alternating conducting and insulating rings is placed on the male body in the pre-determined arrangement.

Each wire is placed in one of the ten channels formed in the male body to allow it to extend to the back of the female component. In one embodiment, each of the five wires adjacent to the back of the male component is placed in one of the five channels formed in the intermediate diameter portion of the male body and their free ends are pushed to the back of the male component. Likewise, each of the wires connected to the first four conducting rings adjacent to the conducting extension is placed in one of the four channels formed in the tip portion of the male body and pushed to the back of the male component. Finally, the wire connected to the frusto-conical conducting extension is placed in the central channel and its free end is pushed to the back of the male component. The conducting extension is then connected to the male body using an end screw which threads into a threaded central opening at the end of the extension.

The male component is oriented with the frustoconical conducting extension facing downward and an adhesive, such as an epoxy-based adhesive is poured into the inner void of the male component via opening in the back of the male component. The adhesive moves into the channels of the male body, surrounds the wires and makes contact with the inner surfaces of the male conducting rings and insulator rings. The male component is then subjected to vacuum to extract any entrained air. More adhesive is added and the process is repeated until the interior of the male component is filled with adhesive. The male component is then heated to cure the adhesive and fix the wires and the alternating conducting and insulating rings in place. In embodiments where the male component includes a high pressure feed through connector at its back end, this connector is connected at this point in the manufacturing process and fixed in place with screws and adhesive according to known methods. O-rings are then added to their respective grooves in the feed through connector.

In some embodiments the female conducting rings, the female conducting springs and the male conducting rings are formed of a beryllium copper alloy.

In some embodiments, the male and female insulating rings are formed of plastic such as polyether ether ketone (PEEK), for example Materials used in construction of the device may be substituted for a higher or lower temperature ratings. For example, gold plating on the contacts reduces oxidation issues. I Advantages The contact surface area and mechanical contact are evenly distributed over each mated contact between the coil springs of the female component and the conducting rings of the male component. The mated contacts in a quiescent state have equal compressive mechanical force and an even contact area. Stresses are distributed over the entire contact surface area. The latching force is accumulative across the 10 contact points which increases the force required to dislodge the connector from its neutral mated position. The feedback of a "click" which occurs when mating is complete (as a result of simultaneous nesting of all of the conducting springs associated with the female component in the corresponding indentations of the conducting rings of the male component) assures a positive alignment. An o-ring internal to the female provides a waterproof seal to protect the electrical connections from water contact and provides a centralized connection. The frustoconical conducting extension at the tip of the connector ensures positive mating and provides alignment along the center axis of the mated connector. The mechanical capture reduces resonant oscillation and resists bending to maintain a distributed contact mating with three-point contact stabilization. In the present embodiment with 10 contact points, it is estimated that a force greater than 20 lb. is required to disconnect the mated connector pair.

Past testing of similar connectors in real world tests, heat tests, vibration tests, resistance tests, and mating/unmating tests have uncovered weak points such as mechanical failures and intermittent shorts/open conductivity. It is anticipated that testing of the device of the present invention will confirm resistance to mechanical failures with maintenance of good electrical contact during vibration and presence in harsh environments.

It is anticipated that incorporation of a positive mating force and self-alignment will reduce problems due to bending and misalignment of the mated connectors. The device of the present invention does not require an exoskeleton to house the connector inside during functional testing. This will be quantified on a vibration table up to 30 G at 5-50 Hz RMS.

The tests to be performed include temperature cycling up to 200° C. for an 8 hour period, underwater submersion at up to 2 atmospheres pressure, bend testing to determine yield point, mating/unmating cycle testing, shock testing up to 1000 G at 1 ms, high current to 10 amps at 24V, isolation testing up to 500V, low resistance testing and pull testing to determine the disconnect force requirement and repeatability.

ALTERNATIVE EMBODIMENTS

The skilled person will recognize that certain variations of the latching mechanism are possible. For example, in an alternative embodiment, instead of a coil spring provided in a cavity of a female conducting ring, a female conducting ring, is provided with a convex shape or protrusion substantially complementary to a concave indentation of the top surface of the male conducting ring. In some embodiments, the material forming the convex shape is compressible to provide a latching force to hold the female conducting ring in contact with the male conducting ring.

The skilled person will recognize that the invention is not to be limited to a device for making only 10 electrical connections. The number of connections (and connector size) can be varied to any practicable amount.

EQUIVALENTS AND SCOPE

Other than described herein, or unless otherwise expressly specified, all of the numerical ranges, amounts, values and percentages, such as those for amounts of materials, elemental contents, times and temperatures, ratios of amounts, and others, in the following portion of the specification and attached claims may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains error necessarily resulting from the standard deviation found in its underlying respective testing measurements. Furthermore, when numerical ranges are set forth herein, these ranges are inclusive of the recited range end points (i.e., end points may be used).

Any patent, publication, internet site, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Unless otherwise defined, all technical and scientific terms used herein have the same meaning as commonly understood by one of ordinary skill in the art to which this invention belongs.

While this invention has been particularly shown and described with references to embodiments thereof, it will be understood by those skilled in the art that various changes in form and details may be made therein without departing from the scope of the invention encompassed by the appended claims.

The invention claimed is:

1. A rotary connector device for making a plurality of electrical connections in a mating arrangement between two components, the device comprising:

a male component with a large diameter end part transitioning to a slope-stepped part having a surface defined by outer sidewalls of alternating male conducting rings and male insulating rings, wherein each of the male conducting rings is connectable to an electrical line; and a female component having a central bore configured to retain a series of alternating female conducting springs and female insulating rings, wherein each of the female conducting springs makes conductive contact with a corresponding male conducting ring of the male conducting rings when the mating arrangement is made, wherein each of the female conducting springs is connectable to an electrical line, wherein the male conducting rings and the female conducting springs have contact surfaces with complementary shapes that engage each other in a latching mechanism when the mating arrangement is made;

wherein the male conducting rings each have circumferential indentations and the conducting springs provide convex surfaces complementary to the indentations of the male conducting rings, wherein mating of the convex surfaces to the indentations provides a compression force for the latching mechanism.

2. The device of claim 1, wherein the conducting springs are held within openings with circumferential cavities in female conducting rings.

3. The device of claim 2, wherein the conducting springs are canted coil springs.

4. The device of claim 2, wherein the circumferential cavities are each defined by a five-sided polygonal inner sidewall defined by two opposed vertical walls connected to a horizontal floor by two angled walls.

5. The device of claim 2, wherein the central bore is non-circular and the female conducting rings and female insulating rings are non-circular.

6. The device of claim 5, wherein the central bore is stadium-shaped and the female conducting rings and female insulating rings are stadium-shaped.

7. The device of claim 2, wherein the central bore has a sidewall with at least one transverse groove formed therein, for providing a channel for application of an adhesive for fixing the female conducting rings and female insulating rings in place during manufacture of the female component.

8. The device of claim 2, wherein the female conducting rings and the female insulating rings have outer slots providing passages for a plurality of electrical lines.

9. The device of claim 2, wherein the male component has a conducting extension configured to enter a matched recess in an insulating ring at the central bore's back end, and wherein entry of the conducting extension into the matched recess serves to centralize the male component to provide consistent circumferential contact of the male conducting rings with corresponding female conducting springs.

10. The device of claim 9, wherein the conducting extension has a frustoconical head portion and an indentation for conductively latching to a corresponding female conducting ring.

11. The device of claim 9, wherein the plurality of electrical connections is 10 separate electrical connections which are made via a combination of 9 male conducting rings and the conducting extension with 10 corresponding female conducting rings.

12. The device of claim 9, wherein the male component has an outer surface which includes a cylindrical portion with one end adjacent the conducting extension and its other end adjacent to the slope-stepped part.

13. The device of claim 1, wherein the slope-stepped part is formed of two slope-stepped portions, each having a different overall slope.

14. A rotary connector device for making a plurality of electrical connections in a mating arrangement between two components, the device comprising:

a male component having an underlying body for holding a series of alternating male conducting rings and separate male insulating rings, the outer sidewalls of the male conducting rings and insulating rings providing an outer surface defining a large diameter end part transitioning to a slope-stepped part; and a female component having a central bore configured to retain a series of alternating female conductor rings and separate female insulating rings, wherein each of the female conducting rings makes direct or indirect conductive contact with a corresponding male conducting ring of the male conducting rings when the mating arrangement is made, wherein each of the female conducting rings is connectable to an electrical line, wherein the male conducting rings and the female conducting rings, or separate conducting components associated therewith, have contact surfaces with complementary shapes that engage each other in a latching mechanism when the mating arrangement is made.

15. The device of claim 14, wherein the complementary shapes of the male conducting rings and the female conducting rings are provided by indentations in the male conducting rings and protrusions in the female conducting rings which are substantially complementary in shape to the indentations.

16. The device of claim 14, wherein the separate conducting components of the female conducting rings are conducting springs held within openings with circumferential cavities in the female conducting rings.

17. The device of claim 16, wherein the conducting springs are canted coil springs.

18. The device of claim 16, wherein the circumferential cavities are each defined by a five-sided polygonal inner sidewall defined by two opposed vertical walls connected to a horizontal floor by two angled walls.

19. The device of claim 16, wherein the male conducting rings each have circumferential indentations and the conducting springs provide convex surfaces complementary to the indentations of the male conducting rings, wherein mating of the convex surfaces to the indentations provides a compression force for the latching mechanism.

20. The device of claim 14, wherein the central bore is non-circular and the female conducting rings and female insulating rings are non-circular.

21. The device of claim 20, wherein the central bore is stadium-shaped and the female conducting rings and female insulating rings are stadium-shaped.

22. The device of claim 14, wherein the central bore has a sidewall with at least one transverse groove formed therein, for providing a channel for application of an adhesive for fixing the female conducting rings and female insulating rings in place during manufacture of the female component.

23. The device of claim 14, wherein the female conducting rings and the female insulating rings have outer slots providing passages for a plurality of electrical lines.

24. The device of claim 14, wherein the male component has a conducting extension configured to enter a matched recess in an insulating ring at the central bore's back end, wherein entry of the conducting extension into the matched recess serves to centralize the male component to provide consistent circumferential contact of the male conducting rings with corresponding female conducting springs.

25. The device of claim 24, wherein the conducting extension has a frustoconical head portion and an indentation for conductively latching to a corresponding female conducting ring.

26. The device of claim 24, wherein the plurality of electrical connections is 10 separate electrical connections which are made via a combination of 9 male conducting rings and the conducting extension with 10 corresponding female conducting rings.

27. The device of claim 24, wherein the male component has an outer surface which includes a cylindrical portion with one end adjacent the conducting extension and its other end adjacent to the slope-stepped part.

28. The device of claim 14, wherein the slope-stepped part is formed of two slope-stepped portions, each having different slopes formed by the male insulating rings.

29. The device of claim 14, wherein the underlying body of the male component is defined by a plurality of channels for separately holding wires for making the electrical connections.

30. A rotary connector device for making a plurality of electrical connections in a mating arrangement between two components, the device comprising:

a male component having a surface defined by outer sidewalls of alternating male conducting rings and male insulating rings, wherein each of the male conducting rings is connectable to an electrical line; and a female component having a central bore configured to retain a series of alternating female conductor rings and female insulating rings, wherein each of the female conducting rings makes direct or indirect conductive contact with a corresponding male conducting ring of the male conducting rings when the mating arrangement is made, wherein each of the female conducting rings is connectable to an electrical line, wherein the male conducting rings and the female conducting rings, or separate conducting components associated therewith, have contact surfaces with complementary shapes that engage each other in a latching mechanism when the mating arrangement is made, and wherein the male component has a conducting extension configured to enter a matched recess in an insulating ring at the central bore's back end, and wherein entry of the conducting extension into the matched recess serves to centralize the male component to provide consistent circumferential contact of the male conducting rings with corresponding female conducting springs.

31. The device of claim 30, wherein the complementary shapes of the male conducting rings and the female conducting rings are provided by indentations in the male conducting rings and protrusions in the female conducting rings which are substantially complementary in shape to the indentations.

32. The device of claim 30, wherein the separate conducting components of the female conducting rings are conducting springs held within openings with circumferential cavities in the female conducting rings.

33. The device of claim 32, wherein the conducting springs are canted coil springs.

34. The device of claim 32, wherein the circumferential cavities are each defined by a five-sided polygonal inner sidewall defined by two opposed vertical walls connected to a horizontal floor by two angled walls.

35. The device of claim 32, wherein the male conducting rings each have circumferential indentations and the conducting springs provide convex surfaces complementary to the indentations of the male conducting rings, wherein mating of the convex surfaces to the indentations provides a compression force for the latching mechanism.

36. The device of claim 30, wherein the central bore is non-circular and the female conducting rings and female insulating rings are non-circular.

37. The device of claim 36, wherein the central bore is stadium-shaped and the female conducting rings and female insulating rings are stadium-shaped.

38. The device of claim 30, wherein the central bore has a sidewall with at least one transverse groove formed therein, for providing a channel for application of an adhesive for fixing the female conducting rings and female insulating rings in place during manufacture of the female component.

39. The device of claim 30, wherein the female conducting rings and the female insulating rings have outer slots providing passages for a plurality of electrical lines.

40. The device of claim 30, wherein the conducting extension has a frustoconical head portion and an indentation for conductively latching to a corresponding female conducting ring.

41. The device of claim 30, wherein the plurality of electrical connections is 10 separate electrical connections which are made via a combination of 9 male conducting rings and the conducting extension with 10 corresponding female conducting rings.

42. The device of claim 30, wherein the male component has an outer surface which includes a cylindrical portion with one end adjacent the conducting extension and its other end adjacent to a slope-stepped part.

43. The device of claim 42, wherein the slope-stepped part is formed of two slope-stepped portions, each having different slopes formed by the male insulating rings.

44. The device of claim 30, wherein the underlying body of the male component is defined by a plurality of channels for separately holding wires for making the electrical connections.

* * * * *